US010317840B2

(12) United States Patent
Lin

(10) Patent No.: US 10,317,840 B2
(45) Date of Patent: Jun. 11, 2019

(54) PROCESS CARTRIDGE

(71) Applicants: Ninestar Corporation, Zhuhai, Guangdong (CN); ZHUHAI FAST IMAGE PRODUCTS CO., LTD., Zhuhai, Guangdong (CN)

(72) Inventor: Chuanjiang Lin, Zhuhai (CN)

(73) Assignees: NINESTAR CORPORATION, Zhuhai, Guangdong (CN); ZHUHAI FAST IMAGE PRODUCTS CO., LTD., Zhuhai, Guangdong (CN)

( * ) Notice: Subject to any disclaimer, the term of this patent is extended or adjusted under 35 U.S.C. 154(b) by 0 days.

(21) Appl. No.: 15/871,916

(22) Filed: Jan. 15, 2018

(65) Prior Publication Data

US 2018/0136605 A1 May 17, 2018

Related U.S. Application Data

(63) Continuation of application No. 15/175,842, filed on Jun. 7, 2016, now Pat. No. 9,904,242.

(30) Foreign Application Priority Data

Apr. 13, 2016 (CN) ..... 2016 1 0227577

(51) Int. Cl.
*G03G 15/00* (2006.01)
*G03G 21/18* (2006.01)

(52) U.S. Cl.
CPC ..... *G03G 21/1842* (2013.01); *G03G 15/757* (2013.01); *G03G 21/186* (2013.01)

(58) Field of Classification Search
CPC ..... G03G 15/757; G03G 21/1842
See application file for complete search history.

(56) References Cited

U.S. PATENT DOCUMENTS 8,417,154 B2 * 4/2013 Nieda ..... G03G 15/757 399/167
2016/0154376 A1 6/2016 Xiao
2017/0351214 A1 * 12/2017 Uesugi ..... G03G 15/00

* cited by examiner

*Primary Examiner* — Hoang X Ngo
(74) *Attorney, Agent, or Firm* — Yue (Robert) Xu; Apex Attorneys at Law, LLP

(57) ABSTRACT

A process cartridge configured to be detachably installed to a main body of the imaging device includes a housing, and a photosensitive drum arranged in the housing. A drive coupler configured to receive a driving force from a drive head of the main body of the imaging device is provided at an end of the photosensitive drum. The process cartridge can be installed to the main body of the imaging device or be detached from the main body of the imaging device in a manner that the photosensitive drum rotation axis forms a variable included angle with respect to the drive head rotation axis. The installation of the process cartridge is facilitated, and the engagement of the drive coupler with the drive head of the imaging device is facilitated.

19 Claims, 15 Drawing Sheets

PROCESS CARTRIDGE

CROSS REFERENCE TO RELATED APPLICATION

The present application is a divisional application of U.S. patent application Ser. No. 15/175,842, filed on Jun. 7, 2016, which claims the benefit of priority to Chinese Patent Application No. 201610227577.5 titled "PROCESS CARTRIDGE", filed with the Chinese State Intellectual Property Office on Apr. 13, 2016, the entire disclosure of which applications are incorporated herein by reference.

FIELD

The present application relates to a process cartridge used in an imaging device.

BACKGROUND

A process cartridge is a cartridge detachably installed in a main body of an imaging device. The process cartridge, as an integral unit, includes a housing, a photosensitive drum disposed in the housing, a developing roller, and etc. The process cartridge is detachable from the main body of the imaging device, thereby facilitating the maintenance of the device. The working process of the imaging device using an electrophotographic imaging method is described as follows. The photosensitive drum which has been uniformly charged by a charging unit is selectively exposed by the light of the imaging device, thereby forming an electrostatic latent image, and the latent image is developed by the developing roller using a toner into a toner image, and the developed toner image is transferred by a transfer printer on a recording medium, and finally, an image is formed on the recording medium.

The main body of the imaging device is provided with various components including a drive motor, a drive head and etc. In the case that the process cartridge is installed in the main body of the imaging device, a drive coupler, arranged at an end of the photosensitive drum, of the process cartridge is connected to the drive head in the main body of the imaging device. In the working process of the imaging device, a driving force is generated by the drive motor, and is transmitted to the drive coupler by the drive head, to finally drive the photosensitive drum to rotate. When installing the conventional process cartridges in the main body of the imaging device, the process cartridge is generally installed with a rotation axis of the photosensitive drum being in parallel with a rotation axis of the drive head, or with the rotation axis of the photosensitive drum being perpendicular to an installation direction of the process cartridge, thus it is difficult to install the process cartridges.

SUMMARY

An object of the present application is to provide a process cartridge which is easy to install.

In order to achieve the above object, the following technical solutions are provided according to the present application.

A process cartridge, configured to be detachably installed to a main body of an imaging device, includes a housing; and a photosensitive drum arranged in the housing, wherein a drive coupler configured to receive a driving force from a drive head of the main body of the imaging device is provided at one end of the photosensitive drum, and wherein an included angle between a photosensitive drum rotation axis and a drive head rotation axis is variable; or the process cartridge is configured to be installed or detached in a manner that an included angle is formed between the photosensitive drum rotation axis and the drive head rotation axis.

Specifically, the photosensitive drum rotation axis has two states, including a first state and a second state; in the first state, the variable included angle is formed between the photosensitive drum rotation axis and the drive head rotation axis; and in the second state, the photosensitive drum rotation axis is coincident with the drive head rotation axis.

Specifically, in a case that the process cartridge is at an installation position or a detaching position, the variable included angle is formed between the photosensitive drum rotation axis and the drive head rotation axis; and in a case that the process cartridge is at a working position, the photosensitive drum rotation axis is coincident with the drive head rotation axis.

Specifically, the included angle varies over a range, from greater than 0 degree to less than or equal to 90 degrees.

Specifically, the included angle varies over a range, from greater than 0 degree to less than or equal to 45 degrees.

Specifically, the included angle varies over a range, from greater than or equal to 5 degrees to less than or equal to 15 degrees.

A process cartridge, configured to be detachably installed to a main body of an imaging device, includes a housing; and a photosensitive drum arranged in the housing, wherein a drive coupler configured to receive a driving force from a drive head of the main body of the imaging device is provided at one end of the photosensitive drum, and wherein a photosensitive drum rotation axis is not perpendicular to a preset installation direction of the process cartridge; or the process cartridge is configured to be installed or detached in a manner that the photosensitive drum rotation axis is not perpendicular to the preset installation direction of the process cartridge.

Specifically, the photosensitive drum rotation axis has two states, including a first state and a second state; in the first state, the photosensitive drum rotation axis is not perpendicular to the preset installation direction of the process cartridge; and in the second state, the photosensitive drum rotation axis is perpendicular to the preset installation direction of the process cartridge.

Specifically, in a case that the process cartridge is at an installation position or a detaching position, the photosensitive drum rotation axis is not perpendicular to the preset installation direction of the process cartridge; and in a case that the process cartridge is at a working position, the photosensitive drum rotation axis is perpendicular to the preset installation direction of the process cartridge.

Specifically, the photosensitive drum rotation axis being not perpendicular to the preset installation direction of the process cartridge refers to that a variable included angle is formed between the photosensitive drum rotation axis and the preset installation direction of the process cartridge, and the included angle varies over a range, from greater than or equal to 0 degree to less than 90 degrees.

Specifically, the included angle varies over a range, from greater than or equal to 0 degree to less than or equal to 85 degrees.

Specifically, the included angle varies over a range, from greater than or equal to 75 degrees to less than or equal to 85 degrees.

A process cartridge, configured to be detachably installed to a main body of an imaging device, includes a housing; and a photosensitive drum arranged in the housing, wherein a drive coupler configured to receive a driving force from a drive head of the main body of the imaging device is provided at one end of the photosensitive drum, and wherein the housing includes a first end plate and a second end plate respectively located at opposite ends of the housing; the first end plate and/or the second end plate is provided with an installation guiding part protruding from the respective end plate; the installation guiding part is configured to allow a photosensitive drum rotation axis to form an included angle with respect to a drive head rotation axis in installing or detaching the process cartridge; or, the installation guiding part is configured to allow the photosensitive drum rotation axis to be not perpendicular to a preset installation direction of the process cartridge in installing or detaching the process cartridge.

A process cartridge, configured to be detachably installed to a main body of an imaging device, includes a housing; and a photosensitive drum arranged in the housing, wherein a drive coupler is provided at an end of the photosensitive drum, and wherein the housing includes a first end plate and a second end plate at opposite ends of the housing; the first end plate and/or the second end plate is provided with an installation guiding part protruding from the respective end plate; and the installation guiding part is extendable and retractable and/or the installation guiding part is provided with a guiding slope.

A process cartridge includes a housing, and the housing includes a first end plate and a second end plate at opposite ends of the housing; the first end plate and/or the second end plate is provided with an installation guiding part protruding from the respective end plate; and the installation guiding part is extendable and retractable and/or the installation guiding part is provided with a guiding slope.

More specifically, the process cartridge is detachably installed to the main body of the imaging device; the process cartridge includes a photosensitive drum arranged in the housing, and a drive coupler configured to receive a driving force from a drive head of the main body of the imaging device is provided at one end of the photosensitive drum.

A process cartridge, includes a housing; a photosensitive drum and a developing drum arranged in the housing, and the photosensitive drum is movable with respect to the developing roller.

Specifically, a drive coupler is provided at one end of the photosensitive drum, and a distance from the end, with the drive coupler, of the photosensitive drum to the developing roller is variable.

Specifically, a photosensitive drum rotation axis can be inclined with respect to a developing roller rotation axis.

Specifically, the photosensitive drum rotation axis has two states, including a first state and a second. In the first state, the photosensitive drum rotation axis is in parallel with the developing roller rotation axis, and in the second state, the photosensitive drum rotation axis is inclined with respect to the developing roller rotation axis.

Specifically, the photosensitive drum of the process cartridge may rotate with respect to the developing roller around a rotating shaft at a side of the process cartridge without the drive coupler.

Specifically, a part including the photosensitive drum of the process cartridge is separable from a part including the developing roller of the process cartridge.

Specifically, the process cartridge is detachably installed to the main body of the imaging device; and when the process cartridge is at an installation position or a detaching position, the developing roller rotation axis always maintains to be perpendicular to the preset installation direction of the process cartridge, and the photosensitive drum rotation axis is inclined with respect to the developing roller rotation axis.

Specifically, the process cartridge is detachably installed to the main body of the imaging device; and when the process cartridge is at the installation position or the detaching position, the photosensitive drum rotation axis is not perpendicular to the installation direction; and when the process cartridge is at the working position, the photosensitive drum rotation axis is perpendicular to the installation direction.

Specifically, the process cartridge is detachably installed to the main body of the imaging device; a drive coupler configured to receive a driving force from a drive head of the main body of the imaging device is provided at one end of the photosensitive drum; when the process cartridge is at the installation position or the detaching position, the photosensitive drum rotation axis may form a variable included angle with respect to the drive head rotation axis; and when the process cartridge is at the working position, the photosensitive drum is coincident with the drive head rotation axis.

Each of the following technical features or the combination thereof may define all the above technical solutions of the process cartridge (including additional features), and for simplifying the expression, the technical features are intensively expressed as follows.

More specifically, a drive coupler rotation axis is coincident with a photosensitive drum rotation axis.

More specifically, in the case that the drive coupler is arranged on the photosensitive drum, the drive coupler rotation axis is coincident with the photosensitive drum rotation axis.

More specifically, in the case that the drive coupler is arranged on the photosensitive drum, the drive coupler rotation axis is coincident with the photosensitive drum rotation axis, and there is no relative displacement between the drive coupler and the photosensitive drum in the direction of the photosensitive drum rotation axis.

More specifically, there is no relative displacement between each component of the drive coupler and the photosensitive drum in the direction of the photosensitive drum rotation axis.

More specifically, the housing includes a first end plate and a second end plate located at two ends of the housing; the first end plate and/or the second end plate is provided with an installation guiding part protruding from the respective end plate.

More specifically, the installation guiding part is extendable and retractable and/or the installation guiding part is provided with a guiding slope.

More specifically, the first end plate is provided with a first installation guiding part, the first installation guiding part has a first guiding slope extending rearward from a front end of the first installation guiding part, and an included angle between the first guiding slope and a plane perpendicular to the drive head rotation axis or between the first guiding slope and an installation direction in a clockwise direction is greater than 90 degrees; and the drive coupler and the second end plate are located at the same side of the housing.

More specifically, the second end plate is provided with a second installation guiding part, and the second installation guiding part has a second guiding slope extending forward from a rear end of the second installation guiding part, and an included angle between the second guiding slope and a plane perpendicular to the drive head rotation axis or between the second guiding slope and the installation direction in a clockwise direction is greater than 90 degrees.

More specifically, the second end plate is provided with a second installation guiding part, the second installation guiding part has a second guiding slope extending forward from a rear end of the second installation guiding part, and the first guiding slope and the second guiding slope are in parallel with each other.

More specifically, the first installation guiding part and the second installation guiding part are distributed at two sides of the photosensitive drum rotation axis.

More specifically, the first installation guiding part is located ahead of the second installation guiding part.

More specifically, the installation guiding part is movable along a direction in parallel with a photosensitive drum rotation axis.

More specifically, an elastic member is provided between the installation guiding part and the respective end plate of the first end plate and the second end plate.

More specifically, the installation guiding part has one end fixed to the respective end plate of the first end plate and the second end plate, and another end extendable and retractable with respect to the respective end plate.

More specifically, the first end plate is provided with a first installation guiding part, a front end of the first installation guiding part is fixed to the first end plate, and a rear end of the first installation guiding part is made of an elastomer, or an elastic member is provided between the rear end of the first installation guiding part and the first end plate; the second end plate is provided with a second installation guiding part, a rear end of the second installation guiding part is fixed to the second end plate, and a front end of the second installation guiding part is made of an elastomer, or an elastic member is provided between the front end of the second installation guiding part and the second end plate.

More specifically, the first end plate and/or the second end plate is provided with an inclined wall which is not perpendicular to a photosensitive drum rotation axis, and in a case that the process cartridge is at an initial installation position, the inclined wall is in parallel with a plane perpendicular to a drive head rotation axis.

More specifically, the inclined wall includes a first inclined wall extending rearward from a front end of the first end plate, and a second inclined wall extending forward from a rear end of the second end plate.

More specifically, the first inclined wall is in parallel with the second inclined wall.

More specifically, the process cartridge is designed to include a part having a photosensitive drum and a part having a developing roller, the part having the photosensitive drum and the part having the developing roller are rotatable about a hinge configured to connect the part having the photosensitive drum and the part having the developing roller, and the hinge is located at an end, without the drive coupler, of the photosensitive drum.

More specifically, in a case that the process cartridge is at an installation position, a variable included angle is formed between a photosensitive drum rotation axis and a developing roller rotation axis; and in a case that the process cartridge is at a working position, the photosensitive drum rotation axis is in parallel with the developing roller rotation axis.

Specifically, in a case that the process cartridge is at the working position, the part having the photosensitive drum and the part having the developing roller are fastened at an end, where the drive coupler is located, of the process cartridge by a fastening mechanism.

Specifically, in a direction of a photosensitive drum rotation axis, a length of the photosensitive drum is greater than a length of the rest part of the process cartridge.

Specifically, in a direction of a photosensitive drum rotation axis, a length of a part of the housing configured to enclose the photosensitive drum is greater than a length of the rest part of the housing of the process cartridge.

Specifically, a handle is provided in the housing, and the handle is located at a rear portion of the process cartridge, and a distance between the handle and an end plate where the drive coupler is located is greater than a half of a length of the process cartridge.

Specifically, the process cartridge is provided with a connecting rod extending through the first end plate and/or the second end plate, and a button configured to control extending and retracting of the connecting rod is provided on the handle.

Specifically, a first connecting part is provided at the bottom of the button, and a first abutting elastic member is provided between the first connecting part and an inner wall of the housing; a connecting-rod guiding part passed through by the connecting rod is provided in the housing; an end, facing the first connecting part, of the connecting rod is provided with a second connecting part, and a second abutting elastic member is provided between the second connecting part and the connecting-rod guiding part, the first connecting part is in contact with the second connecting part, and contact surfaces of the first connecting part and the second connecting part are slopes in parallel with each other, and an included angle between each of the slopes and an axis of the connecting rod in a clockwise direction is greater than 90 degrees.

Specifically, a top of the housing is provided with a positioning assembly, the positioning assembly includes a positioning guide rail, a rotating shaft, and a biasing elastic member, the positioning guide rail is arranged on the housing by the rotating shaft, the biasing elastic member is arranged between the positioning guide rail and a side wall of the housing, or between the positioning guide rail and a wall of the second end plate, and the positioning guide rail is rotatable from a position which is not in parallel with a plane perpendicular to a drive head rotation axis or not in parallel with an installation direction to a position which is in parallel with the plane perpendicular to the drive head rotation axis or in parallel with the installation direction.

A method for installing or detaching the process cartridge according to any one of the above solutions includes installing or detaching the process cartridge in a manner that a photosensitive drum rotation axis forms an included angle with respect to a drive head rotation axis, or installing or detaching the process cartridge in a manner that the photosensitive drum rotation axis is not perpendicular to an installation direction.

Specifically, the method includes installing the process cartridge into a chamber of the main body of the imaging device in a manner that the photosensitive drum rotation axis forms the included angle with respect to the drive head rotation axis or in a manner that the photosensitive drum rotation axis is not perpendicular to the installation direction, to allow the drive coupler to come into contact with the drive head of the main body of the imaging device; continuing to move the process cartridge towards the inside of the chamber of the main body of the imaging device, the drive coupler being blocked by the drive head, and rotating another end of the process cartridge clockwise around a contact point where the drive coupler is in contact with the drive head to a state in which the photosensitive drum rotation axis is coincident with the drive head rotation axis, to allow the drive coupler to be engaged with the drive head, and accomplishing the installation process; to detach the process cartridge, the drive coupler engaged with the drive head being unable to move outwards, moving the process cartridge outwards, to move outwards another end of the process cartridge being not restricted, and at the same time, rotating the other end of the process cartridge by a certain angle counterclockwise around the contact point where the drive coupler is in contact with the drive head, and rotating the photosensitive drum accordingly, disengaging the drive coupler from the drive head, and accomplishing the detaching process.

A method for installing or detaching the process cartridge according to any one of the above solutions includes installing or detaching the part having the photosensitive drum of the process cartridge in a manner that a photosensitive drum rotation axis forms an included angle with respect to a drive head rotation axis, or installing or detaching the part having the photosensitive drum of the process cartridge in a manner that the photosensitive drum rotation axis is not perpendicular to the installation direction.

Specifically, the method includes installing the process cartridge into a chamber of the main body of the imaging device in a manner that the photosensitive drum rotation axis forms the included angle with respect to the drive head rotation axis or in a manner that the photosensitive drum rotation axis is not perpendicular to the installation direction, to allow the drive coupler to come into contact with the drive head of the main body of the imaging device; continuing to move the process cartridge towards the inside of the chamber of the main body of the imaging device, the drive coupler being blocked by the drive head, and rotating another end of the process cartridge clockwise around a contact point where the drive coupler is in contact with the drive head to a state in which the photosensitive drum rotation axis is coincident with the drive head rotation axis, to allow the drive coupler to be engaged with the drive head; then, rotating the part having the developing roller forward around the hinge, and reducing an angle between the photosensitive drum rotation axis and a developing roller rotation axis till the photosensitive drum rotation axis is in parallel with the developing roller rotation axis, and fastening the part having the photosensitive drum to the part having the developing roller, and accomplishing the installation process; to detach the process cartridge, the drive coupler engaged with the drive head being unable to move outwards, moving the process cartridge outwards, to move outwards another end of the process cartridge being not restricted, and at the same time, rotating the other end of the process cartridge by a certain angle counterclockwise around the contact point where the drive coupler is in contact with the drive head, and rotating the photosensitive drum accordingly, disengaging the drive coupler from the drive head, and accomplishing the detaching process.

According to the above technical solutions, since the process cartridge according to the present application can be installed to the main body of the imaging device or be detached from the main body of the imaging device in the manner that the photosensitive drum rotation axis forms a variable included angle with respect to the drive head rotation axis, or the process cartridge can be installed to the main body of the imaging device or be detached from the main body of the imaging device in the manner that the photosensitive drum rotation axis is not perpendicular to the installation direction. That is, when the process cartridge is at the installation position or the detaching position, the photosensitive drum rotation axis forms a variable included angle with respect to the drive head rotation axis, or the photosensitive drum rotation axis is not perpendicular to the installation direction; and when the process cartridge is at the working position, the photosensitive drum rotation axis is coincident with the drive head rotation axis, or the photosensitive drum rotation axis is perpendicular to the installation direction. Therefore, the installation of the process cartridge is facilitated, and the engagement of the drive coupler with the drive head of the main body of the imaging device is facilitated.

BRIEF DESCRIPTION OF THE DRAWINGS

In order to more clearly illustrate embodiments of the present application, drawings referred to describe the embodiments or the conventional technology will be briefly described hereinafter. Apparently, the drawings in the following description are only some embodiments of the present application, and for those skilled in the art, other drawings may be obtained based on the drawings provided without any creative efforts.

The embodiments of the present application are further described in detail hereinafter in conjunction with the drawings.

DETAILED DESCRIPTION

The present application is described in detail hereinafter in conjunction with the drawings, and in describing the embodiments of the present application in detail, for ease of illustration, the drawings showing the structure of components will be partially enlarged at specific scales, and the schematic views are only exemplary, which are not intended to limit the scope of the present application. It is to be noted that, the drawings are all depicted in extremely simplified forms and at inaccurate scales, and are only for the purpose of assisting to conveniently and clearly describe the embodiments of the present application.

First Embodiment

Figure 1:
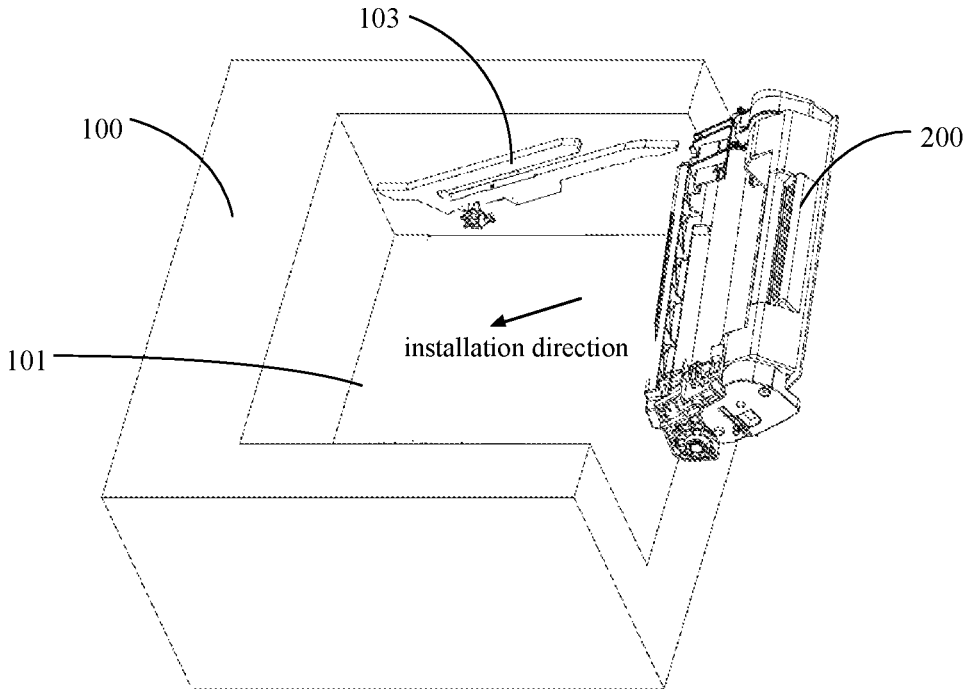
FIG. 1 is a schematic view showing installing a process cartridge into an imaging device.

As shown in FIG. 1, a main body 100 of the imaging device has a chamber 101 configured to accommodate a process cartridge. A guide rail 103 configured to guide the installation of the process cartridge is provided on each of two side walls of the chamber 101, and a drive head 102 configured to drive a photosensitive drum of the process cartridge to rotate is provided on one side wall of the chamber 101. The process cartridge 200 is installed to the main body 100 of the imaging device along the guide rails 103 in an installation direction set by the main body 100 of the imaging device. When the process cartridge 200 is installed in position, the drive head 102 cooperates with a drive coupler on the process cartridge 200, to drive the photosensitive drum of the process cartridge 200 to rotate.

For ease of description, a position where the process cartridge is located when the process cartridge is to be installed to the main body of the imaging device, however, yet is not installed in position is referred to as an installation position, and in this state, the drive head of the main body of the imaging device is not engaged with or is not fully engaged with the drive coupler of the process cartridge; a position where the process cartridge is located when the process cartridge is to be detached from the main body of the imaging device, however, yet is not completely detached is referred to as a detaching position; and a position where the process cartridge is located when the process cartridge is already installed on the imaging device and can work normally is referred to as a working position, and in this state, the drive head of the main body of the imaging device is assembled with the drive coupler of the process cartridge, and is fully engaged with the drive coupler of the process cartridge. A side directed by arrows (not including an arrow indicating a rotation axis) in FIGS. 1 and 2*a* is defined as "front", and a side opposite to the direction of the arrows is defined as "rear".

Figure 2A:
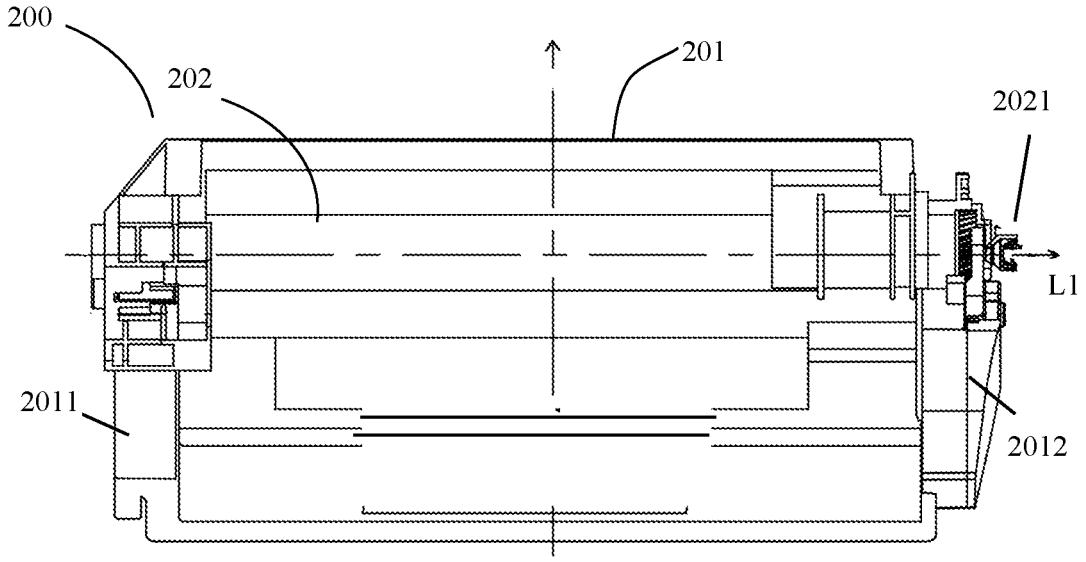
FIG. 2*a* is a schematic view showing the structure of a process cartridge according to a first embodiment.
Figure 2B:
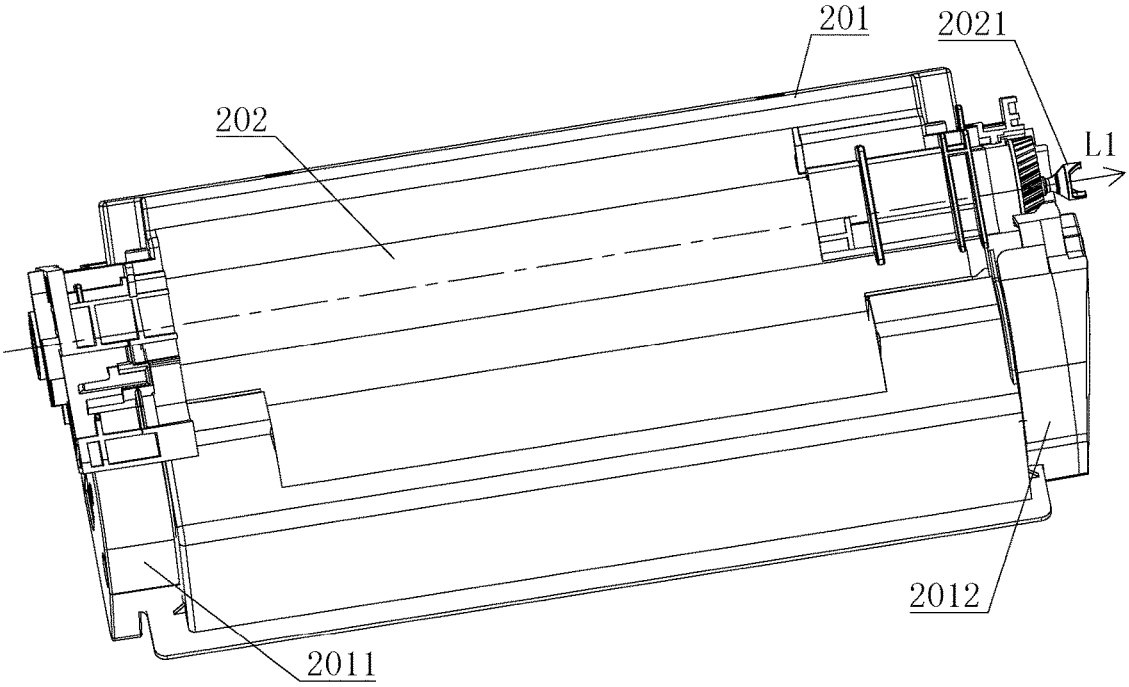
FIG. 2*b* is a schematic view showing the structure of the process cartridge according to the first embodiment from another view angle.

As shown in FIGS. 2*a* and 2*b*, the process cartridge 200 includes a housing 201, a first end plate 2011 and a second end plate 2012 respectively arranged at opposite ends of the housing 201, and a photosensitive drum 202 arranged in the housing 201. One end of the photosensitive drum 202 is provided with a drive coupler 2021, and the photosensitive drum 202 and the drive coupler 2021 can rotate about a rotation axis L1 of the photosensitive drum 202 (i.e., a photosensitive drum rotation axis). In this embodiment, the second end plate refers to an end plate located at the same side of the process cartridge as the drive coupler, or, the second end plate refers to an end plate close to the drive head when the process cartridge is installed on the main body of the imaging device. In this embodiment of the present application, the drive coupler 2021 is fixed to the photosensitive drum 202, that is, the drive coupler 2021 cannot incline with respect to the photosensitive drum 202. That is, in the case that the drive coupler is arranged on the photosensitive drum, a rotation axis of the drive coupler 2021 (i.e., a drive coupler rotation axis) coincides with the rotation axis of the photosensitive drum 202. More preferably, the drive coupler 2021 cannot incline with respect to the photosensitive drum 202 and cannot axially move or axially extend and retract with respect to the photosensitive drum 202. That is, in the case that the drive coupler is arranged on the photosensitive drum, the rotation axis of the drive coupler 2021 coincides with the rotation axis of the photosensitive drum 202, and there is no relative displacement between the drive coupler 2021 and the photosensitive drum 202 in the direction of the photosensitive drum rotation axis.

Figure 3A:
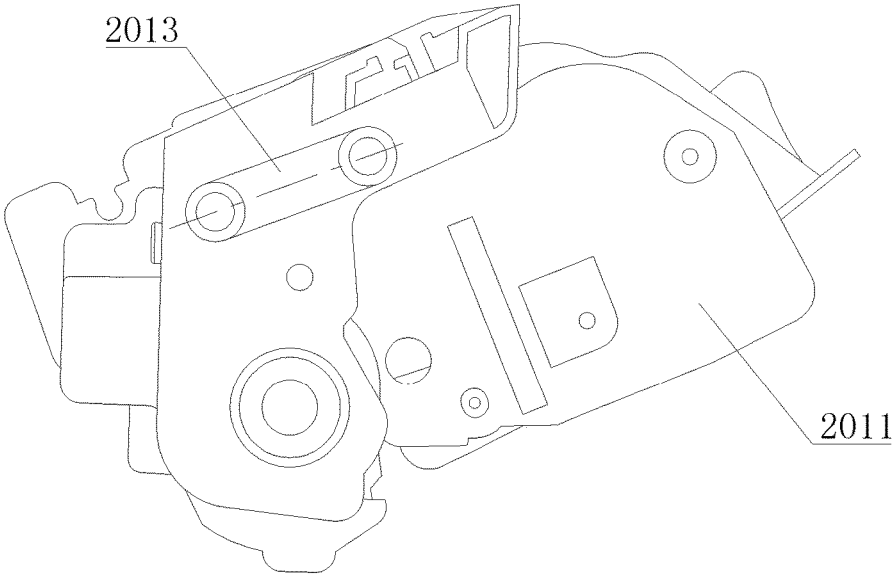
FIG. 3*a* is a schematic view showing the structure of a second end plate in the first embodiment.
Figure 3B:
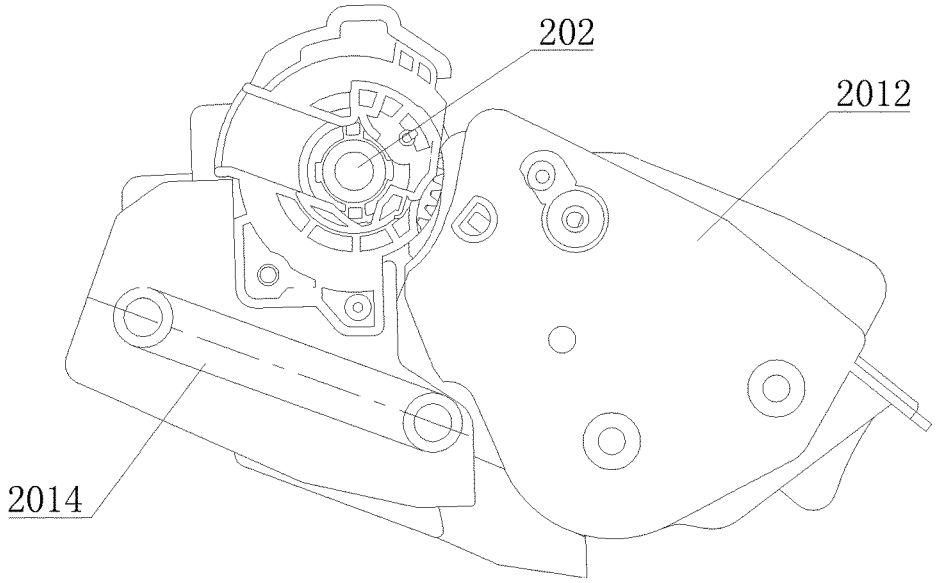
FIG. 3*b* is a schematic view showing the structure of a first end plate in the first embodiment.
Figure 4:
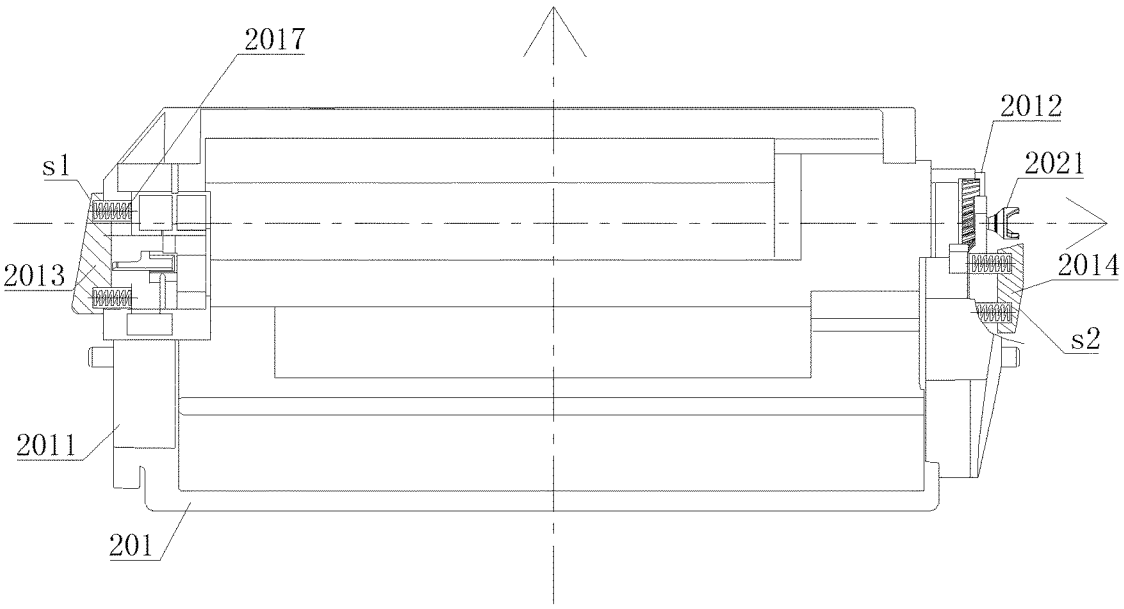
FIG. 4 is a schematic sectional view showing a partial structure of the process cartridge according to the first embodiment.

At least one end plate of the process cartridge is provided with an installation guiding part protruding from the end plate, and the installation guiding part may cooperate with the respective guide rail on the main body of the imaging device, to guide the installation of the process cartridge. As shown in FIGS. 3*a* and 3*b*, in the process cartridge according to this embodiment, the first end plate 2011 is provided with a first installation guiding part 2013, the second end plate 2012 is provided with a second installation guiding part 2014, and the drive coupler 2021 is at the same side as the second end plate 2012. Further, the first installation guiding part 2013 and the second installation guiding part 2014 are distributed at two sides of the photosensitive drum rotation axis L1, for example, the first installation guiding part 2013 is located ahead of the second installation guiding part 2014. As shown in FIG. 4, the first installation guiding part 2013 has a first guiding slope s1 extending rearward from a front end of the first installation guiding part 2013. An included angle, in a clockwise direction, between the first guiding slope s1 and a plane perpendicular to a rotation axis of the drive head (i.e., a drive head rotation axis L2) is greater than 90 degrees, that is, a distance between the first guiding slope s1 and the first end plate 2011 gradually increases in a direction from a front end to a rear end of the first guiding slope s1. The second installation guiding part 2014 has a second guiding slope s2 extending forward from a rear end of the second installation guiding part 2014. An included angle, in the clockwise direction, between the second guiding slope s2 and the plane perpendicular to the drive head rotation axis L2 is greater than 90 degrees, that is, a distance between the second guiding slope s2 and the second end plate gradually increases in a direction from a rear end to a front end of the second guiding slope s2. The first guiding slope s1 is in parallel with the second guiding slope s2, and an included angle is formed between each of the guiding slopes and the plane perpendicular to the drive head rotation axis L2.

Preferably, the first installation guiding part 2013 and the second installation guiding part 2014 can move along a direction in parallel with the rotation axis L1. Elastic members 2017 are provided between the first installation guiding part 2013 and the first end plate 2011, as well as between the second installation guiding part 2014 and the second end plate 2012. Under the action of the elastic forces of the elastic members 2017, the first installation guiding part 2013 and the second installation guiding part 2014 extend outwards, to protrude from the first end plate and the second end plate respectively. When being stressed, the first installation guiding part 2013 and the second installation guiding part 2014 may move in directions towards the respective end plates.

Figure 5:
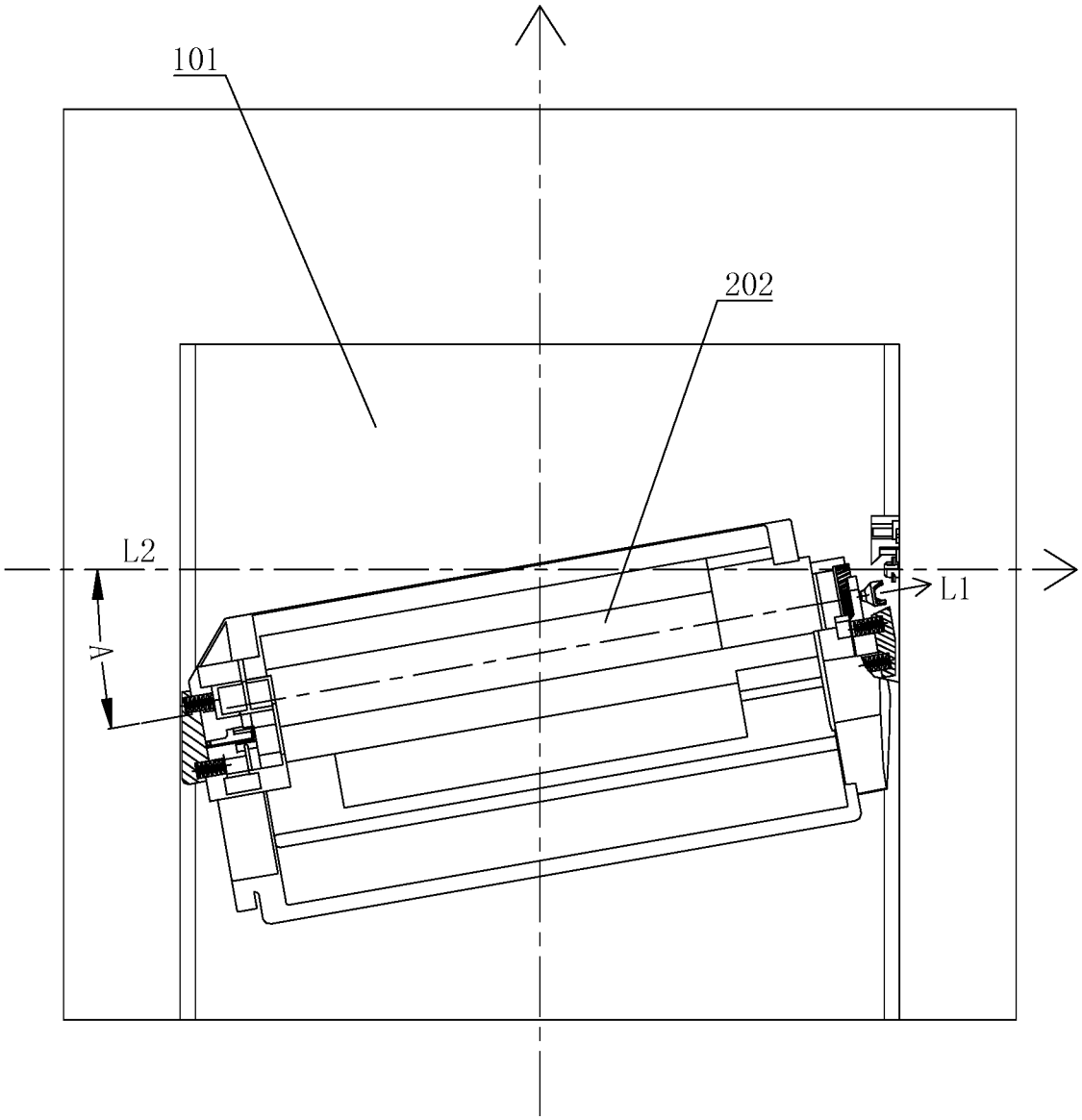
FIG. 5 is a schematic view showing the process cartridge according to the first embodiment at an installation position.
Figure 6:
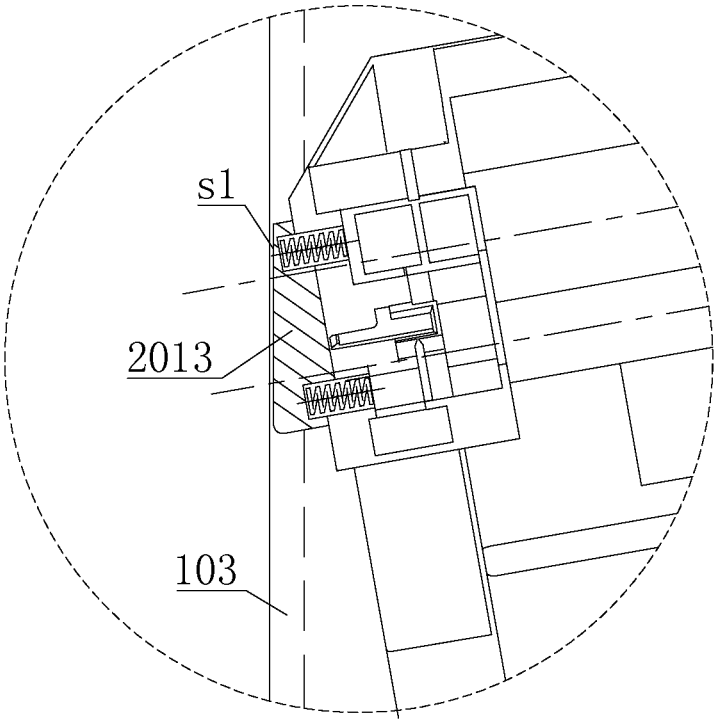
FIG. 6 is a schematic view showing the cooperation between a first mount guiding part and a guide rail when the process cartridge according to the first embodiment is at the installation position.
Figure 7:
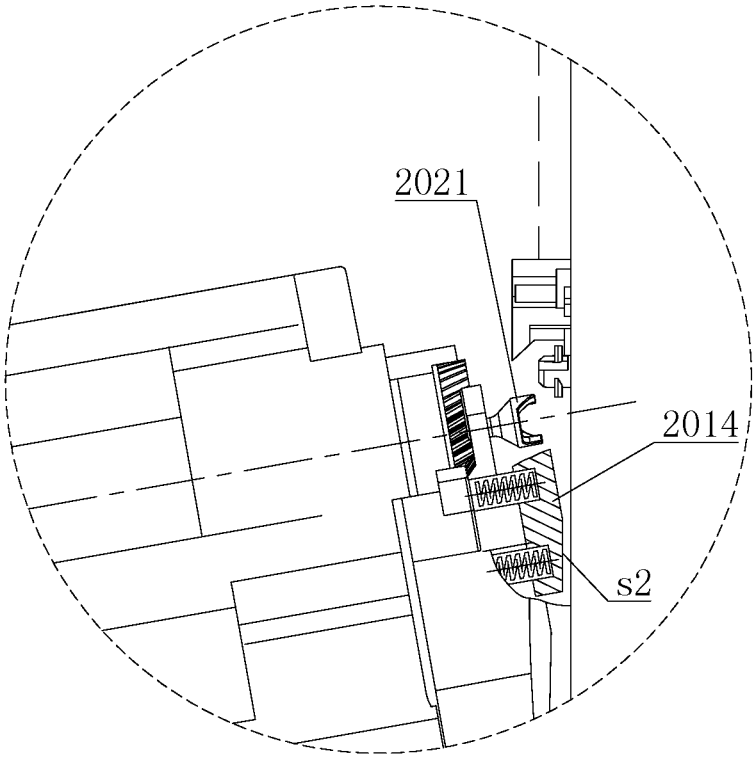
FIG. 7 is a schematic view showing the cooperation between a second installation guiding part and the guide rail when the process cartridge according to the first embodiment is at the installation position.

Reference is made to FIGS. 5, 6, and 7. Since the installation guiding parts protrude from the respective end plates, when mounting the process cartridge, the first installation guiding part 2013 and the second installation guiding part 2014 respectively extend into the guide rails 103 of the main body of the imaging device, and the first installation guiding part 2013 and the second installation guiding part 2014 move along the guide rails 103 respectively. Also since the first installation guiding part 2013 has the first guiding slope s1 extending rearward from the front end of the first installation guiding part 2013, after the first installation guiding part 2013 extends into the respective guide rail 103, the first guiding slope s1 cooperates with the guide rail 103, to allow the process cartridge (the photosensitive drum) to be inclined by a certain angle with respect to the plane perpendicular to the drive head rotation axis L2, and an included angle A is formed between the photosensitive drum rotation axis L1 and the drive head rotation axis L2, and the included angle A may vary as the process cartridge moves. The included angle A between the photosensitive drum rotation axis L1 and the drive head rotation axis L2 is greater than 0 degree, and less than 90 degrees, and preferably, 0 degree<A≤45 degrees, and more preferably, 5 degrees≤A≤15 degrees.

The first installation guiding part and the second installation guiding part according to this embodiment may each have a long stripe shape, or may be in the shape having one or more circular protrusions, elliptic protrusions, or square protrusions and the like.

Further, a front portion of the first end plate 2011 has a first inclined wall 2015 which is not perpendicular to the photosensitive drum rotation axis L1, and the first inclined wall 2015 extends rearward from the front end of the first end plate 2011. A rear portion of the second end plate 2012 has a second inclined wall 2016 which is not perpendicular to the photosensitive drum rotation axis L1, and the second inclined wall 2016 extends forward from the rear end of the second end plate 2012. In this embodiment, when the process cartridge is at an initial installation position (referring to a state in which the process cartridge just enters the main body of the imaging device, the installation guiding parts just enter the guide rails of the main body of the imaging device, and the guiding slopes just come into contact with walls of the guide rails and pressures has not been generated), the first inclined wall 2015 and the second inclined wall 2016 are in parallel with the plane perpendicular to the drive head rotation axis L2. The first inclined wall 2015 and the second inclined wall 2016 being not perpendicular to the photosensitive drum rotation axis L1 may be embodied in the manner that a part of one or more side walls constituting the end plate is not perpendicular to the photosensitive drum rotation axis L1 or the entire side wall constituting the end plate is not perpendicular to the photosensitive drum rotation axis L1.

The process for installing the process cartridge to the main body of the imaging device and the process for detaching the process cartridge from the main body of the imaging device are described as follows.

Figure 8:
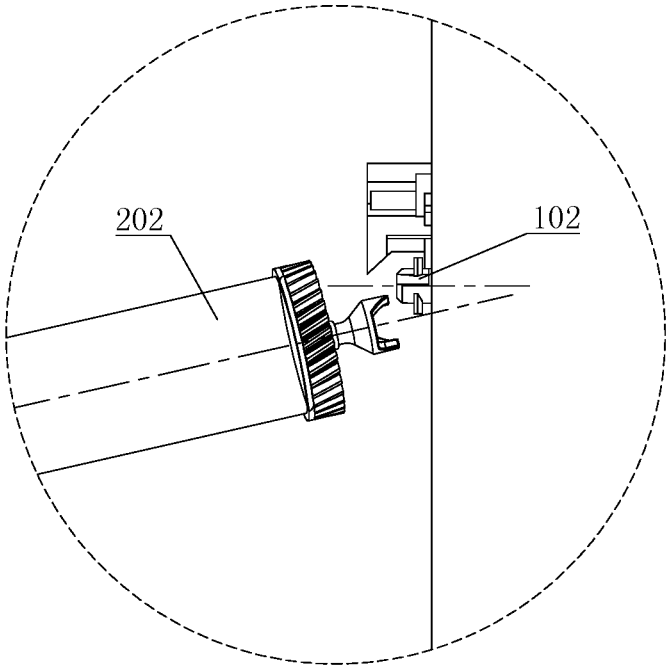
FIG. 8 is a schematic view showing positions of a drive coupler and a drive head when the process cartridge according to the first embodiment is at the installation position.
Figure 9:
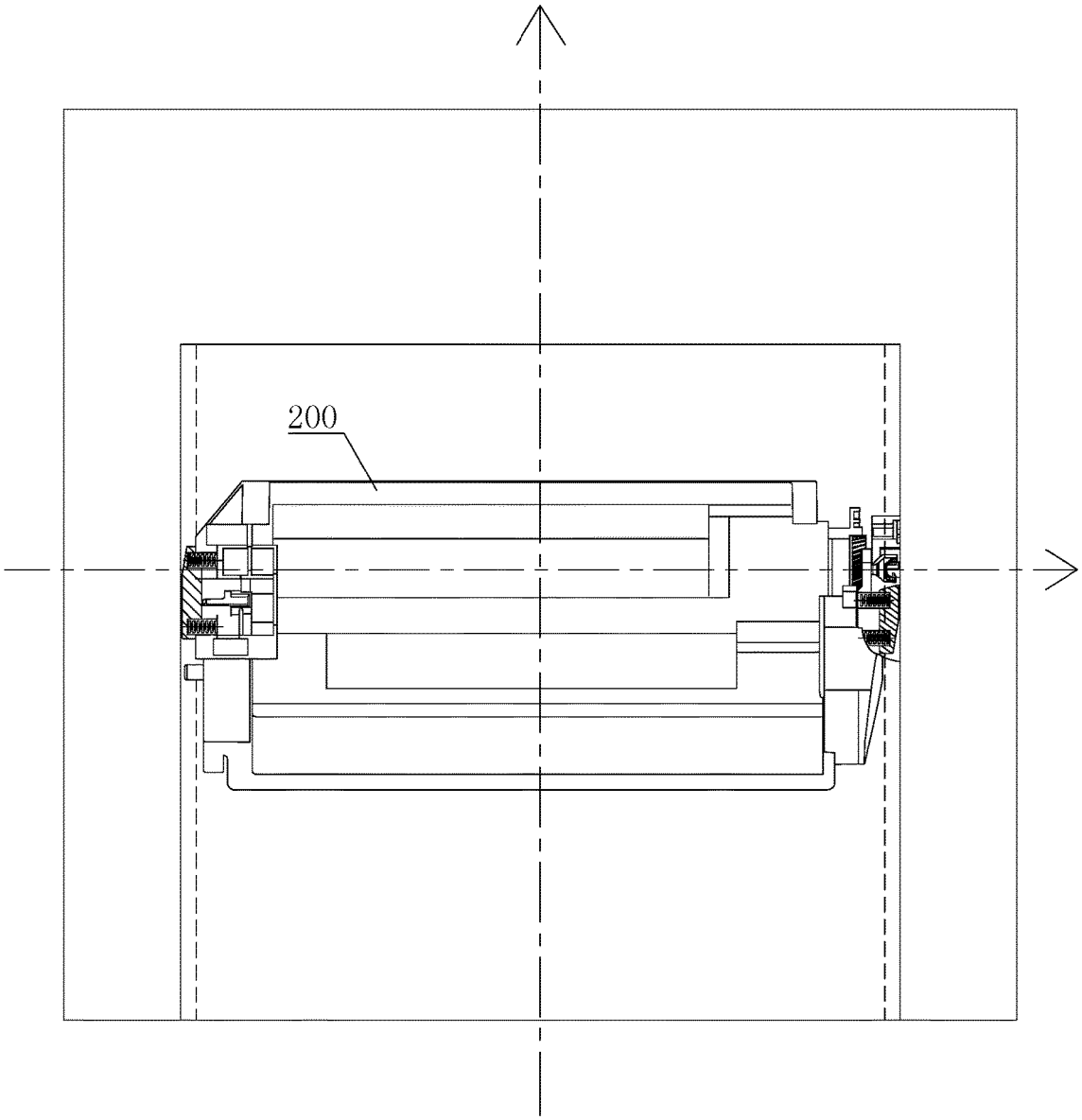
FIG. 9 is a schematic view showing the process cartridge according to the first embodiment at a working position.
Figure 10:
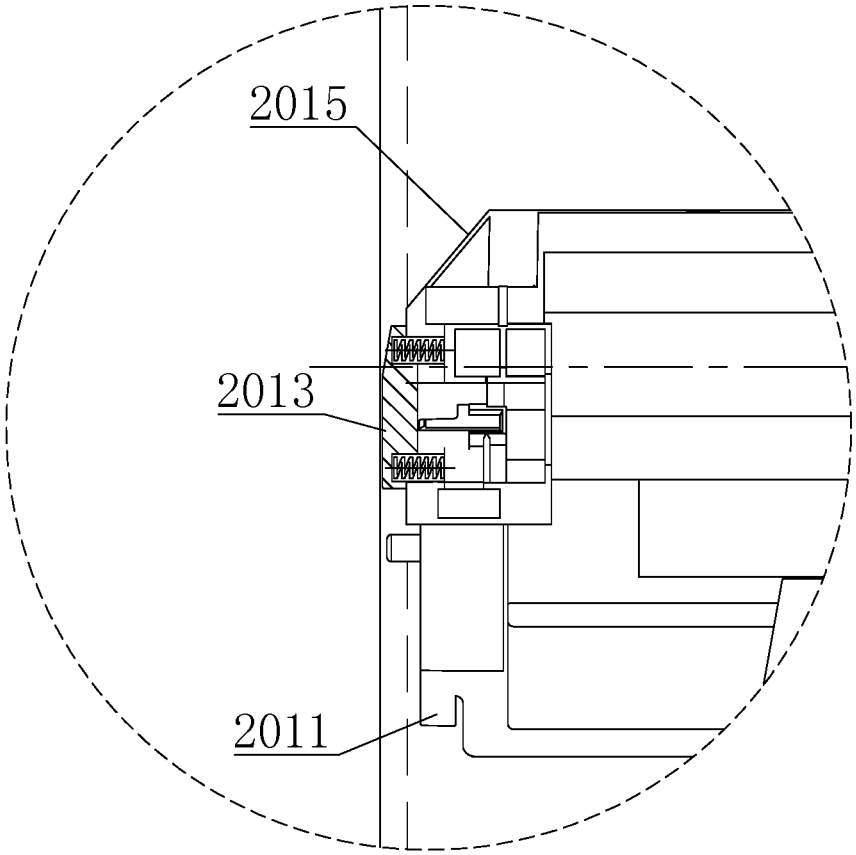
FIG. 10 is a schematic view showing the cooperation between the first installation guiding part and the guide rail when the process cartridge according to the first embodiment is at the working position.
Figure 11:
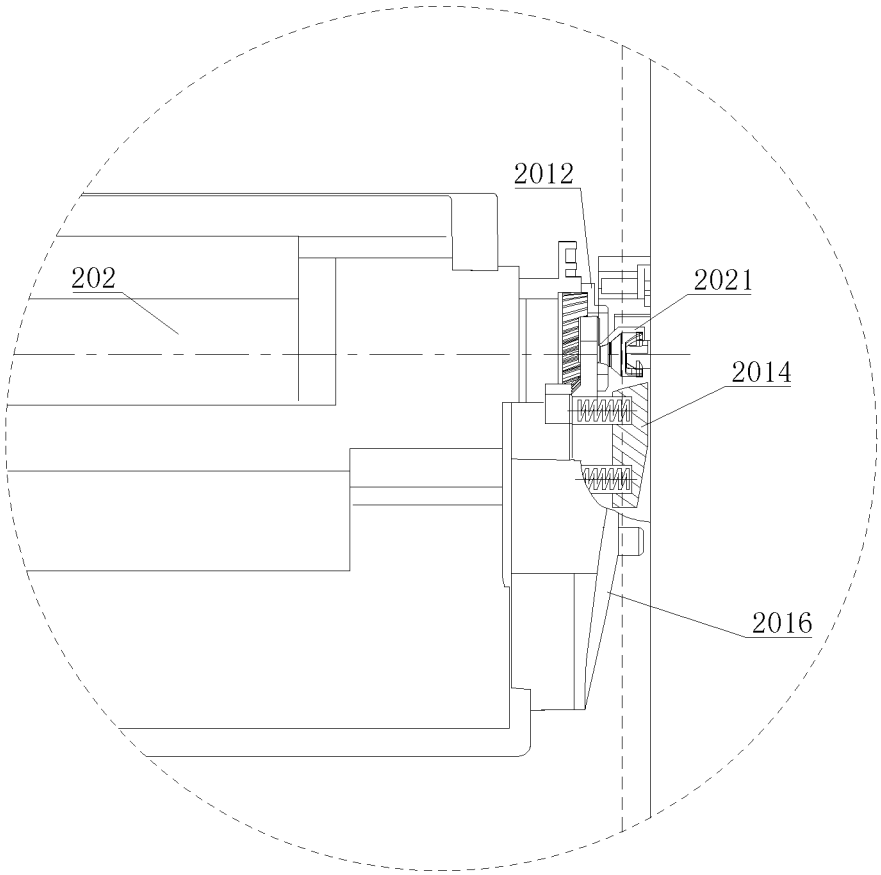
FIG. 11 is a schematic view showing the cooperation between the second installation guiding part and the guide rail when the process cartridge according to the first embodiment is at the working position.
Figure 12:
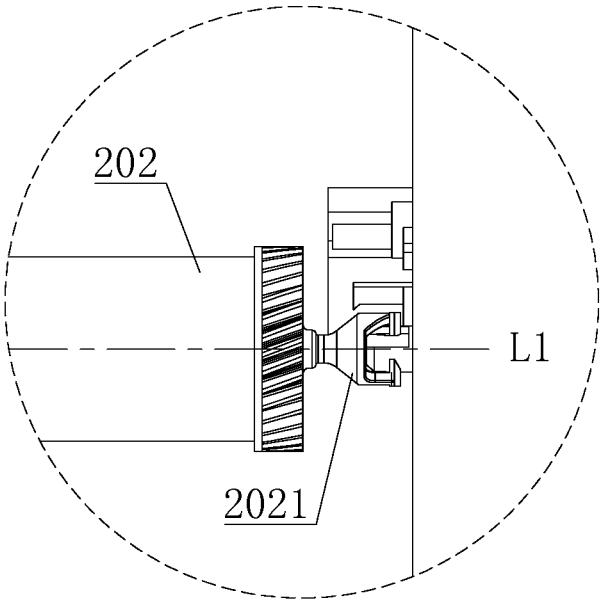
FIG. 12 is a schematic view showing positions of the drive coupler and the drive head when the process cartridge according to the first embodiment is at the working position.

The process for installing the process cartridge is described as follows. The process cartridge enters into the chamber 101 of the imaging device in a manner that an included angle is formed between the photosensitive drum rotation axis L1 and the drive head rotation axis L2. The drive coupler 2021 approaches the drive head 102 of the main body of the imaging device at a certain angle A (as shown in FIG. 8), and when the process cartridge moves to a position where the drive coupler 2021 comes into contact with the drive head 102, the drive coupler 2021 is blocked by the drive head 102 as the process cartridge moves further towards the chamber 101, and cannot continue to move forward, and at the same time, the other end of the process cartridge (the photosensitive drum) is not blocked and continues to move forward, and the first installation guiding part 2013 and the second installation guiding part 2014 may be pressed inward, and the other end of the process cartridge rotates clockwise by an angle A around a contact point where the drive coupler 2021 is in contact with the drive head 102, till the photosensitive drum rotation axis L1 coincides with the drive head rotation axis L2, and thus the engagement of the drive coupler 2021 with the drive head 102 is achieved.

As shown in FIGS. 9, 10, 11, and 12, when the process cartridge 200 is successfully installed and enters into the working position, the rotation axis of the photosensitive drum 202 is coincident with the drive head rotation axis L2, and the drive coupler 2021 engages with the drive head 102. The first installation guiding part 2013 and the second installation guiding part 2014 are stressed during the rotation of the process cartridge, and are allowed to overcome elastic forces of respective elastic members 2017, to respectively move towards the first end plate 2011 and the second end plate 2012, thereby achieving the installation process.

The process for detaching the process cartridge is described as follows. The process for detaching the process cartridge from the main body of the imaging device is opposite to the process for installing the process cartridge to the main body of the imaging device. When detaching the process cartridge, the drive coupler 2021 is engaged with the drive head 102, and cannot move outwards, while as the process cartridge is removing outwards, the other end of the photosensitive drum 202 is not restricted and can move outwards, thus, at this time, the other end of the process cartridge rotates counterclockwise by the angle A around the contact point where the drive coupler 2021 is in contact with the drive head 102, and the photosensitive drum 202 also rotates accordingly, and the drive coupler 2021 is disengaged from the drive head 102, therefore detaching the process cartridge from the imaging device.

In this embodiment, with the installation guiding parts and/or the inclined walls on the end plates, it is ensured that an included angle is formed between the photosensitive drum rotation axis and the drive head rotation axis (i.e., the photosensitive drum rotation axis is not perpendicular to the plane of the drive head rotation axis) when the process cartridge is at the installation position, and the engagement of the drive coupler with the drive head may be achieved without requiring the drive coupler rotation axis to be inclined with respect to the photosensitive drum rotation axis, and even without requiring the drive coupler to extend and retract or move along the rotation axis, thereby simplifying the structure of the drive coupler, and also ensuring the stability of force transmission. Of course, in the case that the drive coupler rotation axis is inclined with respect to the photosensitive drum rotation axis, or in the case that the drive coupler rotation axis is not inclined with respect to the photosensitive drum rotation axis, however, the drive coupler extends and retracts or moves axially along the rotation axis, the installation may be further facilitated, and the engagement of the drive coupler with the drive head may be further facilitated.

Second Embodiment

As shown in FIG. 1, a main body 100 of the imaging device has a chamber 101 configured to accommodate a process cartridge. A guide rail 103 configured to guide the installation of the process cartridge is provided on each of two side walls of the chamber 101, and a drive head 102 configured to drive a photosensitive drum of the process cartridge to rotate is provided on one side wall of the chamber 101. The process cartridge 200 is installed to the main body 100 of the imaging device along the guide rails 103 in an installation direction set by the main body 100 of the imaging device (i.e., a predetermined installation direction of the process cartridge, all the installation directions hereinafter have the same meaning). When the process cartridge is installed in position, the drive head 102 cooperates with a drive coupler on the process cartridge, to drive the photosensitive drum of the process cartridge to rotate.

Figure 13:
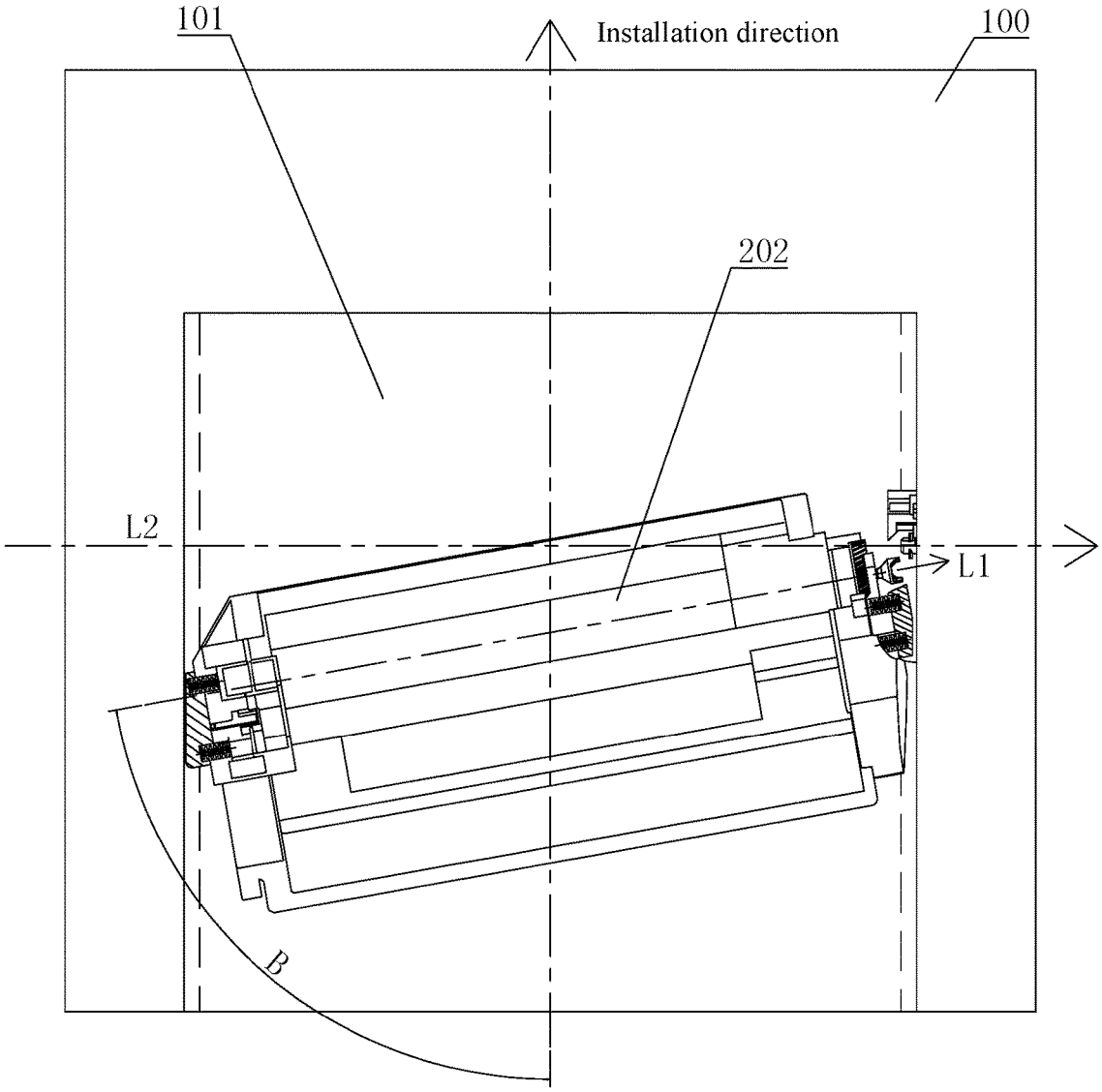
FIG. 13 is a schematic view showing a process cartridge according to a second embodiment at an installation position.
Figure 14:
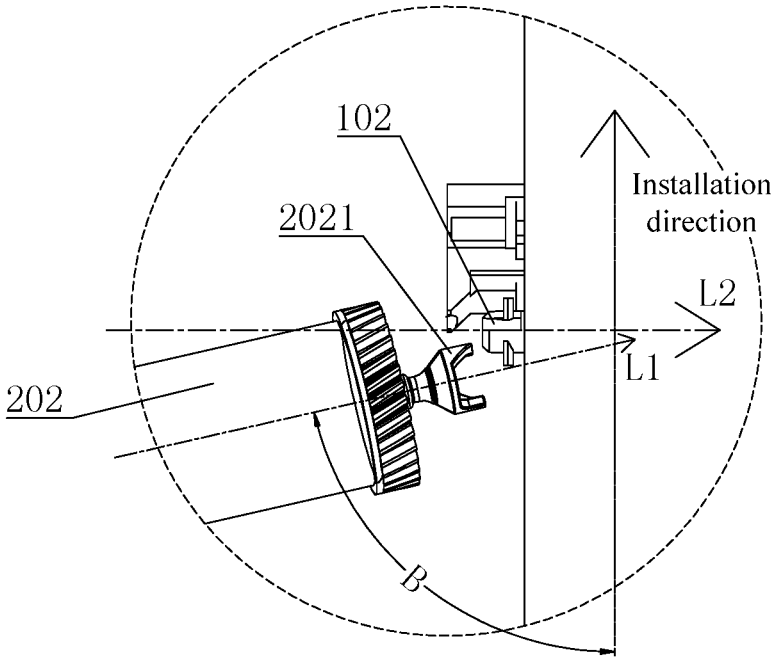
FIG. 14 is a schematic view showing positions of the drive coupler and the drive head when the process cartridge according to the second embodiment is at the installation position.

For ease of description, a position where the process cartridge is located when the process cartridge is to be installed to the main body of the imaging device, however, yet is not installed in position is referred to as an installation position, and in this state, the drive head of the main body of the imaging device is not engaged with or is not fully engaged with the drive coupler of the process cartridge; a position where the process cartridge is located when the process cartridge is to be detached from the main body of the imaging device, however, yet is not completely detached is referred to as a detaching position; and a position where the process cartridge is located when the process cartridge is already installed on the imaging device and can work normally is referred to as a working position, and in this state, the drive head of the main body of the imaging device is assembled with the drive coupler of the process cartridge, and is fully engaged with the drive coupler of the process cartridge. The direction indicated by arrows (not including an arrow of a rotation axis) in FIGS. 1 and 13 is the installation direction, and a side directed by the arrows in FIGS. 1 and 13 is defined as "front", and a side opposite to the direction of the arrows is defined as "rear". In addition, the schematic views used in this embodiment are the same as those used in the first embodiment except for FIGS. 13 and 14.

As shown in FIGS. 2*a* and 2*b*, a process cartridge 200 includes a housing 201, a first end plate 2011 and a second end plate 2012 respectively arranged at opposite ends of the housing 201, and a photosensitive drum 202 arranged in the housing 201. One end of the photosensitive drum 202 is provided with a drive coupler 2021, and the photosensitive drum 202 and the drive coupler 2021 can rotate about a rotation axis L1 of the photosensitive drum 202. In this embodiment, the second end plate refers to an end plate located at the same side of the process cartridge as the drive coupler, or, the second end plate refers to an end plate close to the drive head when the process cartridge is installed to the main body of the imaging device. In this embodiment, the drive coupler 2021 is fixed to the photosensitive drum 202, that is, the drive coupler 2021 cannot incline with respect to the photosensitive drum 202. That is, in the case that the drive coupler 2021 is arranged on the photosensitive drum 202, a rotation axis of the drive coupler 2021 is coincident with the rotation axis of the photosensitive drum 202. More preferably, the drive coupler 2021 cannot incline with respect to the photosensitive drum 202 and cannot axially move or axially extend and retract with respect to the photosensitive drum 202. That is, in the case that the drive coupler 2021 is arranged on the photosensitive drum 202, the rotation axis of the drive coupler 2021 is coincident with the rotation axis of the photosensitive drum 202, and there is no relative displacement between the drive coupler 2021 and the photosensitive drum 202 in the direction of the photosensitive drum rotation axis.

At least one end plate of the process cartridge is provided with an installation guiding part protruding from the end plate, and the installation guiding part may cooperate with the respective guide rail on the main body of the imaging device, to guide the installation of the process cartridge. As shown in FIGS. 3*a* and 3*b*, in the process cartridge according to this embodiment, the first end plate 2011 is provided with a first installation guiding part 2013, the second end plate 2012 is provided with a second installation guiding part 2014, and the drive coupler 2021 is at the same side as the second end plate 2012. Further, the first installation guiding part 2013 and the second installation guiding part 2014 are distributed at two sides of the photosensitive drum rotation axis L1, for example, the first installation guiding part 2013 is located ahead of the second installation guiding part 2014. As shown in FIG. 4, the first installation guiding part 2013 has a first guiding slope s1 extending rearward from a front end of the first installation guiding part 2013. An included angle, in a clockwise direction, between the first guiding slope s1 and the installation direction is greater than 90 degrees, that is, a distance between the first guiding slope s1 and the first end plate 2011 gradually increases in a direction from a front end to a rear end of the first guiding slope s1. The second installation guiding part 2014 has a second guiding slope s2 extending forward from a rear end of the second installation guiding part 2014. An included angle, in the clockwise direction, between the second guiding slope s2 and the installation direction is greater than 90 degrees, that is, a distance between the second guiding slope s2 and the second end plate gradually increases in a direction from a rear end to a front end of the second guiding slope s2. The first guiding slope s1 is in parallel with the second guiding slope s2, and an included angle is formed between each of the guiding slopes and the installation direction.

Preferably, the first installation guiding part 2013 and the second installation guiding part 2014 can move along a direction in parallel with the rotation axis L1. Elastic members 2017 are provided between the first installation guiding part 2013 and the first end plate 2011, as well as between the second installation guiding part 2014 and the second end plate 2012. Under the action of the elastic forces of the elastic members 2017, the first installation guiding part 2013 and the second installation guiding part 2014 extend outwards, to protrude from the first end plate and the second end plate respectively. When being stressed, the first installation guiding part 2013 and the second installation guiding part 2014 may move in directions towards the respective end plates.

Reference is made to FIGS. 13, 14, 6 and 7. Since the installation guiding parts protrude from the respective end plates, when mounting the process cartridge, the first installation guiding part 2013 and the second installation guiding part 2014 respectively extend into the guide rails 103 of the main body of the imaging device, and the first installation guiding part 2013 and the second installation guiding part 2014 move along the guide rails 103 respectively. Also since the first installation guiding part 2013 has the first guiding slope s1 extending rearward from the front end of the first installation guiding part 2013, after the first installation guiding part 2013 extends into the respective guide rail 103, the first guiding slope s1 cooperates with the guide rail 103, to allow the process cartridge (the photosensitive drum) to be inclined by a certain angle with respect to the installation direction, and an included angle B is formed between the photosensitive drum rotation axis L1 and the installation direction (the included angle B may vary as the process cartridge moves), that is, the photosensitive drum rotation axis L1 is not perpendicular to the installation direction when the process cartridge is being mounted. The included angle B between the photosensitive drum rotation axis L1 and the installation direction is less than 90 degrees, and preferably, 5 degrees≤B≤85 degrees, and more preferably, 75 degrees≤B≤85 degrees.

The first installation guiding part and the second installation guiding part according to this embodiment may each have a long stripe shape, or may be in the shape having one or more circular protrusions, elliptic protrusions, or square protrusions and the like.

Further, a front portion of the first end plate 2011 has a first inclined wall 2015 which is not perpendicular to the photosensitive drum rotation axis L1, and the first inclined wall 2015 extends rearward from the front end of the first end plate 2011. A rear portion of the second end plate 2012 has a second inclined wall 2016 which is not perpendicular to the photosensitive drum rotation axis L1, and the second inclined wall 2016 extends forward from the rear end of the second end plate 2012. In this embodiment, when the process cartridge is at an initial installation position (referring to a state in which the process cartridge just enters the main body of the imaging device, the installation guiding parts just enter the guide rails of the main body of the imaging device, and the guiding slopes just come into contact with walls of the guide rails and pressures has not been generated), the first inclined wall 2015 and the second inclined wall 2016 are in parallel with the installation direction. The first inclined wall 2015 and the second inclined wall 2016 being not perpendicular to the photosensitive drum rotation axis L1 may be embodied in the manner that a part of one or more side walls constituting the end plate is not perpendicular to the photosensitive drum rotation axis L1 or the entire side wall constituting the end plate is not perpendicular to the photosensitive drum rotation axis L1.

The process for installing the process cartridge to the main body of the imaging device and the process for detaching the process cartridge from the main body of the imaging device are described as follows.

The process for installing the process cartridge is described as follows. The process cartridge enters into the chamber 101 of the imaging device in a manner that the process cartridge is not perpendicular to the installation direction. The drive coupler 2021 approaches the drive head 102 of the main body of the imaging device at a certain angle A (as shown in FIG. 8), and when the process cartridge moves to a position where the drive coupler 2021 comes into contact with the drive head 102, the drive coupler 2021 is blocked by the drive head 102 as the process cartridge moves further towards the chamber 101, and cannot continue to move forward, and at the same time, the other end of the process cartridge (the photosensitive drum) is not blocked and continues to move forward, and the first installation guiding part 2013 and the second installation guiding part 2014 may be pressed inward, and the other end of the process cartridge rotates clockwise by an angle B around a contact point where the drive coupler 2021 is in contact with the drive head 102, till the photosensitive drum rotation axis L1 is perpendicular to the installation direction, and thus the engagement of the drive coupler 2021 with the drive head 102 is achieved.

As shown in FIGS. 9, 10, 11, and 12, when the process cartridge 200 is successfully mounted and enters into the working position, the rotation axis of the photosensitive drum 202 is perpendicular to the installation direction, and the drive coupler 2021 is engaged with the drive head 102. The first installation guiding part 2013 and the second installation guiding part 2014 are stressed during the rotation of the process cartridge, and are allowed to overcome elastic forces of respective elastic members 2017, to respectively move towards the first end plate 2011 and the second end plate 2012, thereby achieving the installation process.

The process for detaching the process cartridge is described as follows. The process for detaching the process cartridge from the main body of the imaging device is opposite to the process for installing the process cartridge to the main body of the imaging device. When detaching the process cartridge, the drive coupler 2021 is engaged with the drive head 102, and cannot move outwards, while as the process cartridge is removing outwards, the other end of the photosensitive drum 202 is not restricted and can move outwards, thus, at this time, the other end of the process cartridge rotates counterclockwise by the angle A around the contact point where the drive coupler 2021 is in contact with the drive head 102, and the photosensitive drum 202 also rotates accordingly, and the drive coupler 2021 is disengaged from the drive head 102, therefore detaching the process cartridge from the imaging device.

In this embodiment, with the installation guiding parts and/or the inclined walls on the end plates, it is ensured that the photosensitive drum rotation axis is not perpendicular to the installation direction when the process cartridge is at the installation position, and the engagement of the drive coupler with the drive head may be achieved without requiring the drive coupler rotation axis to be inclined with respect to the photosensitive drum rotation axis, and even without requiring the drive coupler to extend and retract or move axially along the rotation axis, thereby simplifying the structure of the drive coupler, and also ensuring the stability of force transmission. Of course, in the case that the drive coupler rotation axis is inclined with respect to the photosensitive drum rotation axis, or in the case that the drive coupler rotation axis is not inclined with respect to the photosensitive drum rotation axis, however, the drive coupler extends and retracts or moves axially along the rotation axis, the installation may be further facilitated, and the engagement of the drive coupler with the drive head may be further facilitated.

Third Embodiment

Figure 15:
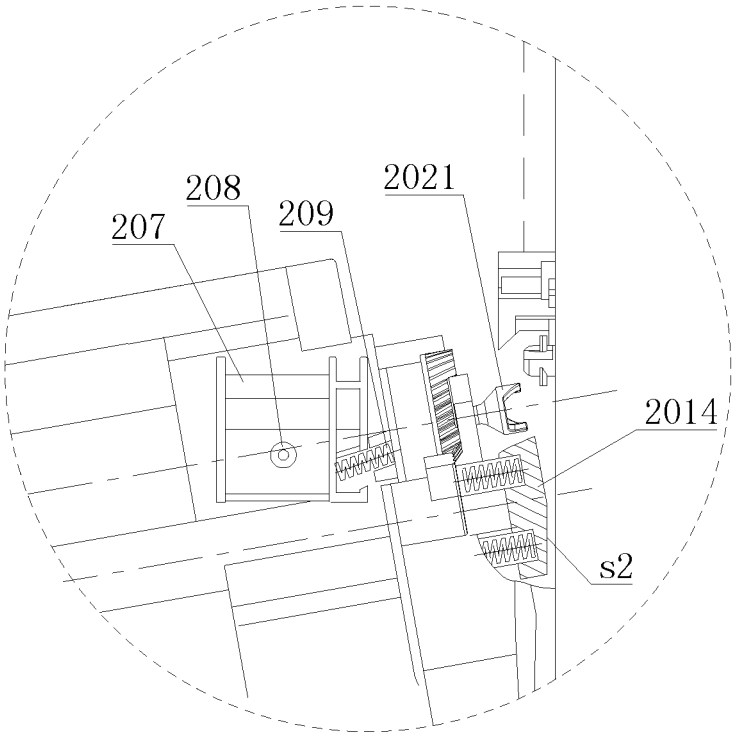
FIG. 15 is a schematic view showing a partial structure of a process cartridge according to a third embodiment at an installation position.
Figure 16:
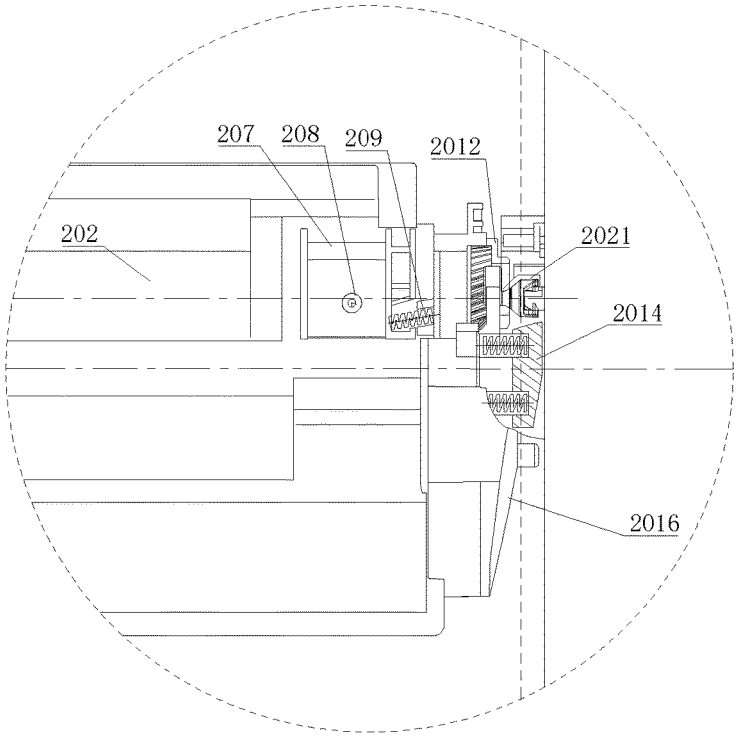
FIG. 16 is a schematic view showing a partial structure of the process cartridge according to the third embodiment at a working position.

As shown in FIGS. 15 and 16, unlike the above embodiments, in this embodiment, a rotatable positioning assembly is provided at the top of the housing (FIGS. 15 and 16), and the positioning assembly includes a positioning guide rail 207, a rotating shaft 208 and a biasing elastic member 209. The positioning guide rail 207 is arranged on the housing 201 by the rotating shaft 208, and an axis of the rotating shaft 208 is perpendicular to a plane where the positioning guide rail 207 is located, and the positioning guide rail 207 may rotate about the rotating shaft 208. The biasing elastic member 209 is arranged between the positioning guide rail 207 and a side wall of the housing 201 or between the positioning guide rail 207 and a wall of the second end plate. Under the action of an elastic force of the biasing elastic member 209, the positioning guide rail 207 is not in parallel with a plane perpendicular to the drive head rotation axis (as shown in FIG. 15). In the case that the process cartridge is installed on the main body of the imaging device, a positioning switch (not shown in the figures), corresponding to the positioning guide rail 207, on the main body of the imaging device abuts against the positioning guide rail 207, to allow the positioning guide rail 207 to overcome the elastic force of the biasing elastic member 209 and rotate from the position which is not in parallel with the plane perpendicular to the drive head rotation axis or not in parallel with the installation direction of the process cartridge to a position in parallel with the plane perpendicular to the drive head rotation axis or in parallel with the installation direction of the process cartridge (as shown in FIG. 16).

Fourth Embodiment

Figure 17:
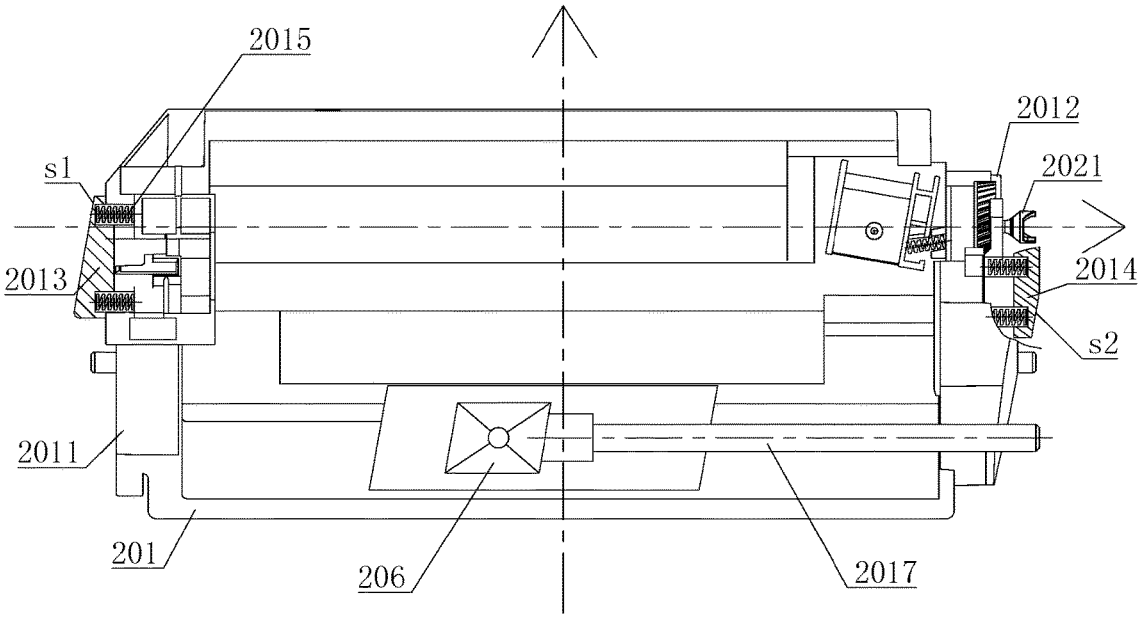
FIG. 17 is a schematic view showing the structure of a process cartridge according to a fourth embodiment.
Figure 18:
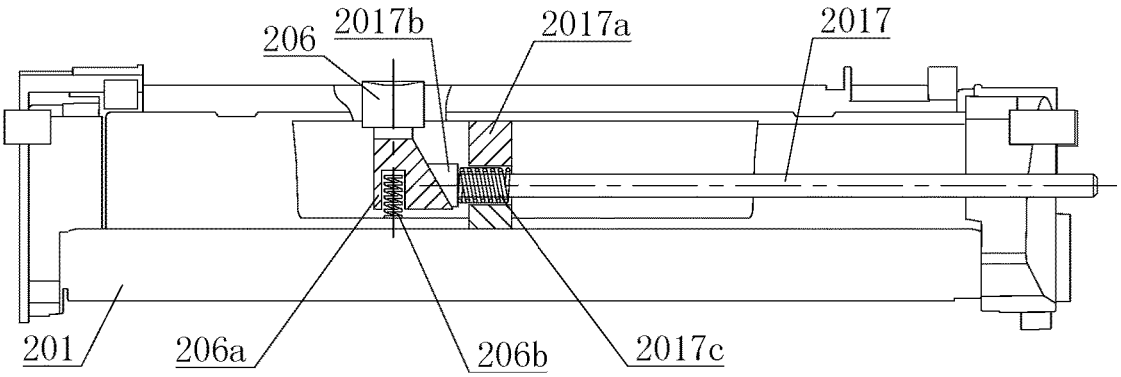
FIG. 18 is a schematic view showing an assembly structure of a handle and a connecting rod in the process cartridge according to the fourth embodiment.

As shown in FIGS. 17 and 18, unlike the above embodiments, in this embodiment, to facilitate securely positioning the process cartridge in the main body of the imaging device when the process cartridge is at the working position, a handle is provided on the housing 201 and is arranged at a rear portion of the process cartridge. A distance between the handle and an end plate where the drive coupler is located is greater than a half of the length of the process cartridge, that is, the distance from the handle to the drive coupler 2021 is greater than the distance from the handle to the other end plate, without the drive coupler, of the process cartridge. The process cartridge is provided with a connecting rod 2017 passing through the first end plate and/or the second end plate. A button 206 is provided on the handle, and a first connecting part 206*a* is provided at the bottom of the button 206. A first abutting elastic member 206*b* is provided between the first connecting part 206*a* and an inner wall of the housing 201. The button 206 and the first connecting part 206*a* may move in a vertical direction under the action of an external force or an elastic force of the first abutting elastic member. A connecting-rod guiding part 2017*a* is provided in the housing 201, and the connecting rod 2017 passes through the connecting-rod guiding part 2017*a* and further extends towards a respective end plate. A second connecting part 2017*b* is provided on an end, facing the first connecting part 206*a*, of the connecting rod 2017. A second abutting elastic member 2017*c* is provided between the second connecting part 2017*b* and the connecting-rod guiding part 2017*a*, and the second abutting elastic member 2017*c* is sleeved on the connecting rod 2017. The first connecting part 206*a* and the second connecting part 2017*b* are in contact with each other, the contact surfaces of the first connecting part 206*a* and the second connecting part 2017*b* are slopes in parallel with each other. An included angle, in a clockwise direction, between each of the slopes and an axis of the connecting rod 2017 is greater than 90 degrees, that is, a distance between each slope and the first abutting elastic member 206*b* is gradually increased in the direction from top to bottom.

When the button 206 on the handle is pressed down, the button 206 and the first connecting part 206*a* overcome an elastic force of the first abutting elastic member 206*b* to move downwards under the action of an external force. During a downward movement of the first connecting part 206*a*, the second connecting part 2017*b* moves along the slope of the first connecting part 206*a*, thereby driving the connecting rod 2017 to retract inwards from the end plate. When the button 206 is released, the button 206 and the first connecting part 206*a* move upwards to return to the original positions under the action of an elastic force of the first abutting elastic member 206*b*. During an upward movement of the first connecting part 206*a*, the second connecting part 2017*b* is pushed outwards by the slope of the first connecting part 206*a*, thereby driving the connecting rod 2017 to extend out of the end plate. Therefore, when the process cartridge is at the installation position, once pressing down the button 206, the connecting rod 2017 retracts, and the process cartridge may be installed normally, and when the process cartridge is at the working position, once releasing the button 206, the connecting rod 2017 extends outwards to abut against the inner wall of the chamber of the imaging device, thereby securely fixing the process cartridge.

Fifth Embodiment

Figure 19:
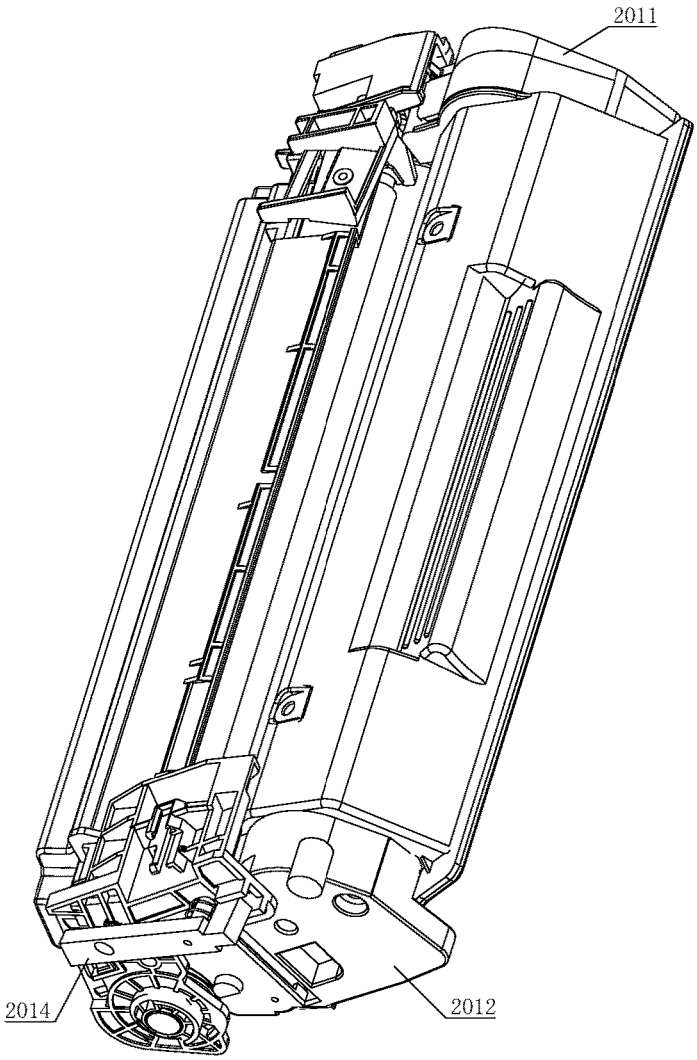
FIG. 19 is a schematic view showing the structure of a process cartridge according to a fifth embodiment.
Figure 20:
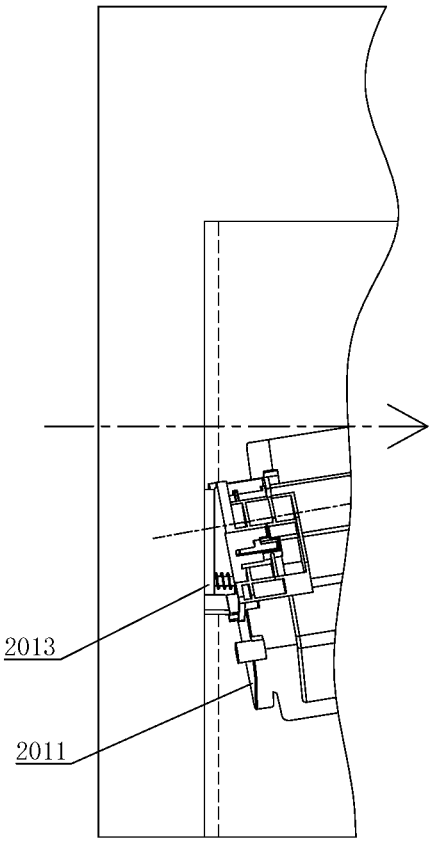
FIG. 20 is a schematic view showing a first installation guiding part when the process cartridge according to the fifth embodiment is at an installation position.
Figure 21:
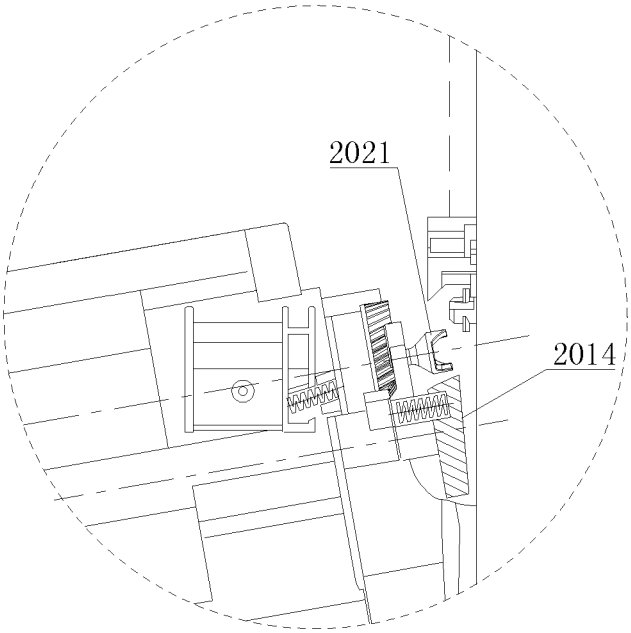
FIG. 21 is a schematic view showing a second installation guiding part when the process cartridge according to the fifth embodiment is at the installation position.

As shown in FIGS. 19, 20 and 21, unlike the first embodiment, in this embodiment, each the installation guiding parts may be further embodied as a structure having one end fixed to a respective one of the first end plate 2011 and the second end plate 2012 and another end extendable and retractable with respect to the respective end plate. Specifically, the first end plate 2011 is provided with a first installation guiding part 2013, and a front end of the first installation guiding part 2013 is fixed to the first end plate 2011, and a rear end of the first installation guiding part 2013 is made of an elastomer, or an elastic member is provided between the rear end of the first installation guiding part 2013 and the first end plate 2011. The second end plate 2012 is provided with a second installation guiding part 2014, and a rear end of the second installation guiding part 2014 is fixed to the second end plate 2012, and a front end of the second installation guiding part 2014 is made of an elastomer, or an elastic member is provided between the front end of the second installation guiding part 2014 and the second end plate 2012. Apparently, as a variation, the installation guiding part having the above structure may be only provided on the first end plate or the second end plate.

Further, as an equivalent variation or a combination of the installation guiding part, the first installation guiding part and/or the second installation guiding part may be embodied as a fixed slope guiding part, a slope guiding part with one end fixed and another end extendable and retractable, an extendable and retractable guiding block, an extendable and retractable guiding block with a slope, and the like.

Sixth Embodiment

Figure 22:
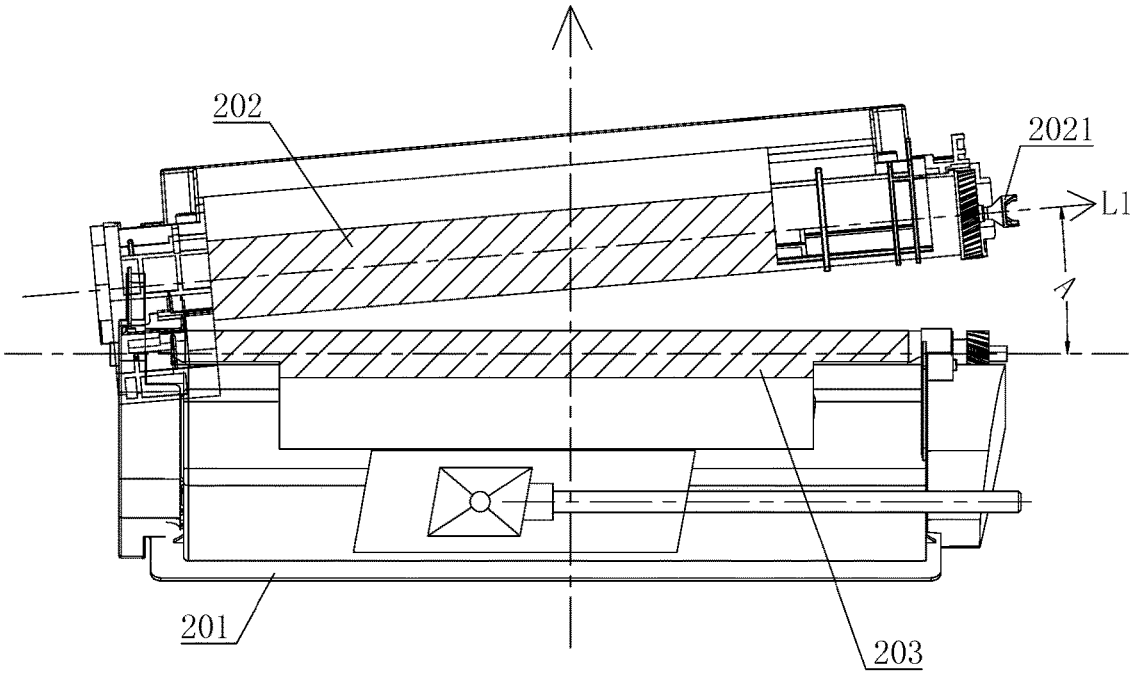
FIG. 22 is a schematic view showing the structure of a process cartridge according to a sixth embodiment.

As shown in FIG. 22, unlike the above embodiments, in this embodiment, the process cartridge is designed to have a part including a photosensitive drum and a part including a developing roller. The part including the photosensitive drum and the part including the developing roller may rotate about a hinge (not shown in the figures) that connects the two parts.

The hinge is located at an end, without the drive coupler, of the photosensitive drum 202, thus allowing the photosensitive drum rotation axis L1 to have two states, including a first state and a second state. In the first state, when the process cartridge is at the installation position, the photosensitive drum rotation axis L1 is inclined with respect to a rotational axis of the developing roller 203 (i.e. a developing roller rotational axis) to form a variable included angle, that is, an included angle is formed between the rotation axis L1 and the drive head rotation axis. In the second state, when the process cartridge is at the working position, the photosensitive drum rotation axis L1 is in parallel with the rotation axis of the developing roller 203, that is, the rotation axis L1 is coincident with the drive head rotation axis. In the case that the photosensitive drum rotation axis L1 is inclined with respect to the rotation axis of the developing roller 203, a distance from the drive coupler 2021 to the developing roller 203 is variable, and in the case that the photosensitive drum rotation axis L1 is in parallel with the developing roller 203, the distance between the drive coupler 2021 and the developing roller 203 is the closest, and in the installation process of the process cartridge, the drive coupler 2021 moves from a position away from the developing roller 203 to a position close to the developing roller 203.

When the process cartridge is at the installation position, an included angle is formed between the rotation axis of the photosensitive drum 202 and the drive head rotation axis, to allow the drive coupler 2021 to be engaged with the drive head of the imaging device at a certain angle. In the case that the drive coupler 2021 is in contact with the drive head, the drive coupler 2021 is restricted by the drive head and unable to move, and as the process cartridge continues to move, the photosensitive drum 202 rotates around the drive coupler by a certain angle in a clockwise direction, and the engagement of the drive coupler 2021 with the drive head is achieved. Meanwhile, the part including the developing roller 203 continues to rotate around the hinge to move forward, an included angle between the photosensitive drum rotation axis L1 and the developing roller is gradually reduced, to allow the photosensitive drum rotation axis L1 to be in parallel with the developing roller rotation axis. Therefore, the drive assembly 2021 is engaged with the drive head, and the process cartridge enters into the working position. When the process cartridge is at the working position, the part including the photosensitive drum and the part including the developing roller are fastened at the end, with the drive coupler, of the process cartridge by a fastening mechanism (not shown in the figures).

To detach the process cartridge from the imaging device, a process opposite to the above installation process is performed. To detach the process cartridge, the drive assembly 2021 is engaged with the drive head and is unable to move outwards, however, the part including the developing roller of the process cartridge may move outwards, the distance between the drive assembly 2021 and the developing roller is gradually increased, and an inclination angle is formed between the photosensitive drum rotation axis L1 and the developing roller rotation axis. Then the other end of the photosensitive drum 202 may move outwards, in this way, the photosensitive drum 202 may rotate around the drive assembly by a certain angle in a counterclockwise direction, and in this way, the drive assembly 2021 may be disengaged from the drive head. The developing roller here is merely a roller configured to develop an image, and may be embodied as a developing drum used in contact type development, or a magnetic roller used in non-contact type development, and the like.

Apparently, the part including the photosensitive drum and the part including the developing roller may be completely separated. The part including the photosensitive drum is installed first and then the part including the developing roller is installed.

Seventh Embodiment

Figure 23:
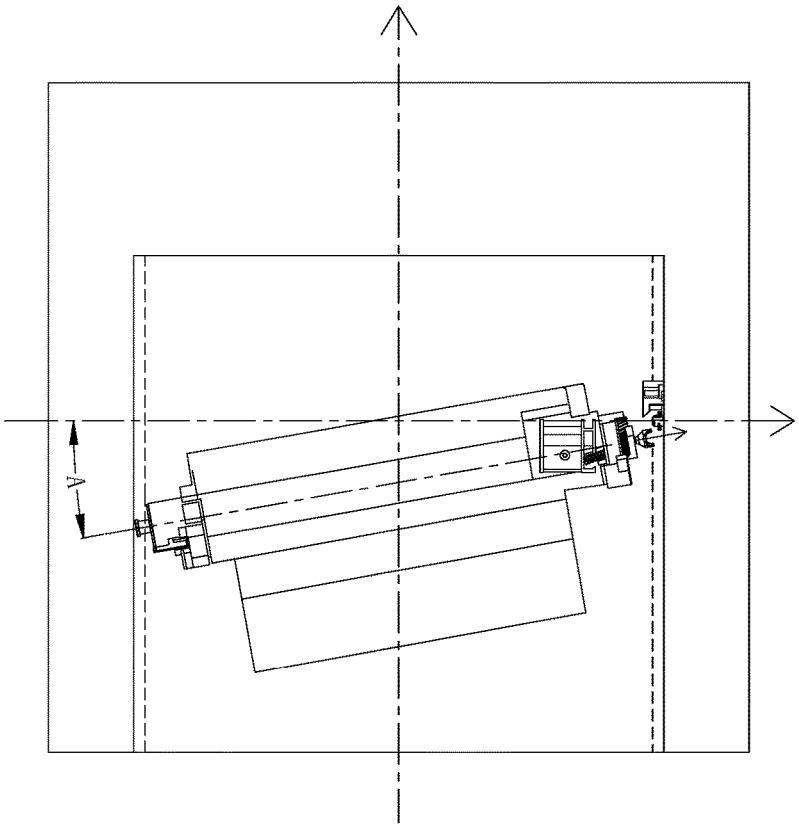
FIG. 23 is a schematic view showing the structure of a process cartridge according to a seventh embodiment.

As shown in FIG. 23, unlike the above embodiments, in this embodiment, in the direction of the photosensitive drum rotation axis, the length of the photosensitive drum is greater than the length of the rest part of the process cartridge. Therefore, when the process cartridge is at the installation position, the process cartridge may have a space to swing, and when the process cartridge is swinging, a variable included angle may be formed between the photosensitive drum rotation axis and the drive head rotation axis. Furthermore, the length of the photosensitive drum being greater than the length of the rest part of the housing may also be embodied in a manner that the length of a part of the housing at a periphery of the photosensitive drum is greater than the length of the rest part of the housing, for example a part of the housing configured to support the photosensitive drum, or a part of the housing configured to fix the photosensitive drum is greater than the length of the rest part of the housing.

It should be noted that, the premise of the present application is that the dimension of an external profile of the process cartridge can meet the following conditions, the process cartridge can be installed to the main body of the imaging device and be detached from the main body of the imaging device in a manner that a variable included angle is formed between the photosensitive drum rotation axis and the drive head rotation axis or the photosensitive drum rotation axis is not perpendicular to the installation direction, and the process cartridge does not interfere with the main body of the imaging device. In other words, the premise is that the dimension of the external profile of the process cartridge allows the process cartridge not to interfere with the main body of the imaging device and meets the following requirements. When the process cartridge is at the installation position or the detaching position, a variable included angle is formed between the photosensitive drum rotation axis and the drive head rotation axis or the photosensitive drum rotation axis is not perpendicular to the installation direction, and when the process cartridge is at the working position, the photosensitive drum rotation axis is coincident with the drive head rotation axis. The definition and implementation of the premises can be easily conceived by those skilled in the art.

Description of each of the embodiments in the specification is mainly focused on describing its differences from other embodiments, and references may be made among these embodiments with respect to the same or similar portions among these embodiments, or these embodiments can also be combined. The combination relationships between these components are not limited to the forms disclosed in the embodiments. Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A process cartridge, configured to be detachably installed to a main body of an imaging device, comprising:

a housing; and a photosensitive drum arranged in the housing, wherein a drive coupler configured to receive a driving force from a driving head of the main body of the imaging device is provided at one end of the photosensitive drum, and a positioning guide rail arranged on a top side of the housing and rotatable relative to the housing, and wherein when the process cartridge is installed into or detached from the main body along a mounting direction or a dismounting direction, the process cartridge is inclined with the mounting direction or the dismounting direction and a variable included angle is formed between a rotation axis of the photosensitive drum and the mounting direction or the dismounting direction in a first state; and the rotation axis of the photosensitive drum is perpendicular to the mounting direction or the dismounting direction in a second state;

or wherein a rotation axis of the driving head is not movable, the process cartridge is movable between a first position that an included angle is formed between a rotation axis of the photosensitive drum and a rotation axis of the driving head, and a second position that the rotation axis of the photosensitive drum is coaxial with the rotation axis of the driving head.

2. The process cartridge according to claim 1, wherein the included angle varies over a range, from greater than 0 degree to less than or equal to 90 degrees.

3. The process cartridge according to claim 2, wherein the included angle varies over a range, from greater than 0 degree to less than or equal to 45 degrees.

4. The process cartridge according to claim 2, wherein the included angle varies over a range, from greater than or equal to 5 degrees to less than or equal to 15 degrees.

5. The process cartridge according to claim 1, wherein when the drive coupler is arranged on the photosensitive drum, a rotation axis of the drive coupler is coincident with the rotation axis of the photosensitive drum.

6. The process cartridge according to claim 1, wherein the housing comprises a first end plate and a second end plate at opposite ends of the housing; the first end plate and/or the second end plate is provided with an installation guiding part protruding from the respective end plate.

7. The process cartridge according to claim 6, wherein the installation guiding part is extendable and retractable and/or the installation guiding part is provided with a guiding slope.

8. The process cartridge according to claim 7, wherein the first end plate is provided with a first installation guiding part, the first installation guiding part has a first guiding slope extending rearward from a front end of the first installation guiding part, and an included angle between the first guiding slope and a plane perpendicular to the rotation axis of the driving head or between the first guiding slope and an installation direction in a clockwise direction is greater than 90 degrees; and the drive coupler and the second end plate are located at the same side of the housing.

9. The process cartridge according to claim 8, wherein the second end plate is provided with a second installation guiding part, the second installation guiding part has a second guiding slope extending forward from a rear end of the second installation guiding part, and the first guiding slope and the second guiding slope are in parallel with each other.

10. The process cartridge according to claim 7, wherein the second end plate is provided with a second installation guiding part, the second installation guiding part has a second guiding slope extending forward from a rear end of the second installation guiding part, and an included angle between the second guiding slope and a plane perpendicular to the rotation axis of the driving head or between the second guiding slope and an installation direction in a clockwise direction is greater than 90 degrees.

11. The process cartridge according to claim 6, wherein the installation guiding part is movable along a direction in parallel with the rotation axis of the photosensitive drum.

12. The process cartridge according to claim 6, wherein an elastic member is provided between the installation guiding part and the respective end plate of the first end plate and the second end plate.

13. The process cartridge according to claim 6, wherein the installation guiding part has one end fixed to the respective end plate of the first end plate and the second end plate, and another end extendable and retractable with respect to the respective end plate.

14. The process cartridge according to claim 6, wherein the first end plate is provided with a first installation guiding part, a front end of the first installation guiding part is fixed to the first end plate, and a rear end of the first installation guiding part is made of an elastomer, or an elastic member is provided between the rear end of the first installation guiding part and the first end plate; the second end plate is provided with a second installation guiding part, a rear end of the second installation guiding part is fixed to the second end plate, and a front end of the second installation guiding part is made of an elastomer, or an elastic member is provided between the front end of the second installation guiding part and the second end plate.

15. The process cartridge according to claim 6, wherein the first end plate and/or the second end plate is provided with an inclined wall which is not perpendicular to the rotation axis of the photosensitive drum, and in a case that the process cartridge is at an initial installation position, the inclined wall is in parallel with a plane perpendicular to the rotation axis of the driving head or is in parallel with an installation direction.

16. The process cartridge according to claim 15, wherein the inclined wall includes a first inclined wall extending rearward from a front end of the first end plate, and a second inclined wall extending forward from a rear end of the second end plate.

17. The process cartridge according to claim 16, wherein the first inclined wall is in parallel with the second inclined wall.

18. The process cartridge according to claim 1, wherein the process cartridge further comprises a biasing elastic member, which is arranged between the positioning guide rail and a portion of the housing, or between the positioning guide rail and a portion of an end plate.

19. The process cartridge according to claim 18, wherein the positioning guide rail is movable between a first position and a second position, the first position is that at least a side wall of the positioning guide rail is perpendicular to the rotation axis of the photosensitive drum, and the second position is that the side wall of the positioning guide rail is inclined with the rotation axis of the photosensitive drum.

* * * * *